US006961075B2

(12) United States Patent
Mindler et al.

(10) Patent No.: US 6,961,075 B2
(45) Date of Patent: Nov. 1, 2005

(54) METHOD AND APPARATUS FOR THERMAL PRINTING OF LONGER LENGTH IMAGES BY THE USE OF MULTIPLE DYE COLOR PATCH TRIADS OR QUADS

(75) Inventors: Robert F. Mindler, Churchville, NY (US); Guy T. Calkins, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 151 days.

(21) Appl. No.: 10/702,896

(22) Filed: Nov. 6, 2003

(65) Prior Publication Data

US 2005/0099487 A1 May 12, 2005

(51) Int. Cl.[7] ..... B41J 2/355
(52) U.S. Cl. ..... 347/183
(58) Field of Search ..... 347/183, 184, 347/172, 174, 176, 178, 188, 193, 196, 212, 213, 217; 400/120.01, 120.02, 120.04, 120.18; 358/3.06, 3.09, 3.1, 3.17

(56) References Cited

U.S. PATENT DOCUMENTS

| | | | | |
|---|---|---|---|---|
| 4,745,413 A | | 5/1988 | Brownstein et al. | |
| 5,132,701 A | | 7/1992 | Stephenson et al. | |
| 5,140,341 A | | 8/1992 | Fiscella et al. | |
| 5,450,099 A | * | 9/1995 | Stephenson et al. | 347/200 |
| 5,815,190 A | * | 9/1998 | Ohshima et al. | 347/171 |
| 6,204,873 B1 | * | 3/2001 | Shimazaki | 347/172 |
| 6,366,306 B1 | * | 4/2002 | Fukuda | 347/172 |

FOREIGN PATENT DOCUMENTS

| | | |
|---|---|---|
| EP | 0 522 980 A2 | 1/1993 |
| EP | 0 619 188 A2 | 10/1994 |
| EP | 0 938 058 A2 | 8/1999 |
| WO | 96/23662 | 8/1996 |

* cited by examiner

*Primary Examiner*—K. Feggins
(74) *Attorney, Agent, or Firm*—Mark G. Bocchetti

(57) ABSTRACT

A method and apparatus of thermally printing an image on a receiver by (a) printing a first sub-image on a first region of the receiver with a first dye-donor patch of the first color and (b) printing a second sub-image on a second region of the receiver with a second dye-donor patch of the first color, wherein the first and second regions of the receiver have a partial overlap region. The first and second sub-images form the image which is longer in length than either of the first and second dye-donor patches. Pixels in the overlap region are printed with varying gray levels during both of steps (a) and (b) and pixel locations in the overlap region are printed by overlapping a partial pixel printed during printing step (a) with another partial printed during printing step (b).

26 Claims, 16 Drawing Sheets

METHOD AND APPARATUS FOR THERMAL PRINTING OF LONGER LENGTH IMAGES BY THE USE OF MULTIPLE DYE COLOR PATCH TRIADS OR QUADS

FIELD OF THE INVENTION

The present invention relates generally to thermal printing of images on receivers using thermal donor media, such as sheet or ribbon, having plural series of different color panels or patches, and more particularly, to improving image quality by the use of printing elongated images.

BACKGROUND OF THE INVENTION

In recent years, digital and video cameras and computer-generated images have found wide acceptance. The demand for digital color printers has increased to provide for an acceptable hard copy output for the images captured or generated by such cameras and computers.

Of the various recording methods, the recording apparatus that employs the thermal transfer method using an ink donor ribbon makes it easier to maintain the apparatus. In addition, full-color images of higher quality are obtainable with such apparatus. Typically, there is a reasonable match between the size of the ink donor color panel or patch on the ribbon and the corresponding size of the image to be recorded on the receiver sheet.

Thermal dye sublimation or diffusion printers use heat to cause colored dyes on the ink donor ribbon medium to transfer to a receiver medium that is in intimate contact with the donor ribbon. Over the past 20 years a new printing technology known as "resistive head thermal printing" has emerged. Thermal printers are used for a variety of printing needs, ranging from inexpensive monotone fax printers, to near photographic quality continuous tone color images. The highest quality output is produced by the dye diffusion thermal printer. The thermal printing operation is driven by a thermal print head that consists of a number of resistive heating elements closely arranged along the axis of the head. Between 200 and 600 heating elements are aligned per inch. During the dye diffusion printing process, the thermal printhead is brought into contact with a dye coated donor ribbon (see FIG. 1). A chemically coated receiver sheet sits beneath the donor ribbon. The donor/receiver surfaces are compressed between the printhead bead and an elastomeric drum creating a very small but highly pressured nip contact region.

The high pressure creates the intimate contact between the layers that is necessary for efficient thermal transfer. During printing, each resistive element on the head is pulsed with current in order to create heat. This heat then drives the diffusion process. By manipulating the thermal resistor pulsing scheme one can control the temperature history, and subsequently the amount of diffusion taking place beneath each resistor. In the color dye diffusion process three printing passes are used to overlay yellow, magenta, and cyan dye. The result is a high quality, continuous tone color image.

Most printers which employ this process have the property that once a point of the thermal donor media has been used it cannot be reused, as insufficient amounts of dye remain at that point for a second use. Thermal dye donor media come in standard configurations such as a roll or ribbon composed of a series of interleaved cyan, magenta, and yellow (CMY) panels or patches herein below referred to as a triad of color patches. Thermal donor media also come in standard sizes. An additional panel or patch may also be provided with the series of color patches so as to provide a transparent ink panel or patch for transferring a transparent overcoat to a multiple color image formed on the receiver sheet. The thermal transfer medium including the three color panels or patches and a transparent overcoat panel or patch are referred to hereinbelow as a quad of color patches.

In the field of printing of images, and with regard to U.S. Pat. Nos. 5,132,701 and 5,140,341, there is disclosed a method and apparatus to produce an image on relatively large receivers using a thermal printer having multiple color dye transfer patch triads. In the aforesaid patents, there is noted the problem in thermal printing of printing on a receiver that is longer than the length of the dye transfer patch that is available. Thus, image size has typically been limited to the size of a dye donor film patch used to produce the image. To overcome this problem, the aforesaid patents teach steps of producing a first sub-image with a segment thereof having blank areas which are distributed in accordance with a pattern that does not produce a substantially linear alignment of the blank areas with one another. The second sub-image is produced with a segment thereof having blank areas which are distributed in accordance with a pattern that is complementary to the pattern of the blank areas of the first sub-image.

A problem associated with the methods disclosed by prior art is that the image processing requirements for the printers disclosed in the prior art may be more difficult to implement with efficient image processing time and thus may also require greater CPU time by the host computer. Particularly when used in a kiosk environment, where the CPU is required to implement a number of tasks beyond interface with the printer, it is desirable to reduce the need for reducing the communication time with the host computer and the printer when implementing image processing. It also would be desirable to reduce the likelihood of print variation when producing multiple prints of the same image.

It is therefore desirable to produce large images that are free of visually discernible distortions and which can be produced with conventional dye-donor triad or quad films that provide superior results obtainable using gray level pixels.

The various objects and advantages described herein will become more apparent to those skilled in the art from description of preferred embodiments of the invention which follows. In the description, reference is made to accompanying drawings, which form a part thereof, and which illustrate examples of the invention. Such examples, however, are not exhaustive of the various possible embodiments of the invention, and therefore reference is made to the claims which follow the description for determining the scope of the invention.

SUMMARY OF THE INVENTION

In accordance with a first aspect of the invention there is provided a method of thermally printing a desired image on a receiver comprising the steps of (a) thermally printing a first sub-image on a first region of the receiver with a first dye-donor patch of a first color having a length that is less than a length of the receiver; (b) thermally printing a second sub-image on a second region of the receiver with a second dye-donor patch of the first color and having a length that is less than the length of the receiver; the first and second regions of the receiver having a partial overlap region; the first and second sub-images form the desired image (or a single color printed record of the desired image) which is longer in length than either of the first and second dye-donor patches; wherein in steps (a) and (b) the thermal printing is made with the same printhead having a plurality of thermally actuated recording elements, the recording elements being actuated to print the first sub-image and the second sub-image each with pixels of varying gray levels, and further wherein pixels in the overlap region are printed with varying gray levels during both of steps (a) and (b) and wherein at pixels locations in the overlap region most printed pixels are printed by overlapping a partial pixel printed during printing step (a) with another partial pixel printed during printing step (b).

In accordance with a second aspect of the invention, there is provided a method of thermally printing a desired image on a receiver with a printhead comprising the steps of (a) thermally printing with the printhead a first sub-image on a first region of the receiver with a first dye-donor patch of a first color having a length that is less than than a length of the receiver; (b) subsequent to step (a) thermally printing with the printhead a second sub-image on a second region of the receiver with a second dye-donor patch of the first color and having a length that is less than the length of the receiver; the first and second regions of the receiver having a partial overlap region; the first and second sub-images form the desired image (or a single color printed record of the desired image) which is longer in length than either of the first and second dye-donor patches; (c) thermally transferring a transparent overcoat on the first sub-image in the first region exclusive of the overlap region of the receiver with a first transparent donor patch of a length that is less than the length of the receiver; (d) thermally transferring a transparent overcoat on the second sub-image in the second region inclusive of the overlap region of the receiver with a second transparent donor patch having a length that is less than the length of the receiver; and wherein in steps (c) and (d) the thermal transferring is made with the same printhead as used in steps (a) and (b) and wherein step (d) is performed after step (c).

In accordance with a third aspect of the invention, there is provided a method and apparatus of thermal printing to form an elongated image wherein material is transferred from a donor sheet having a repeating series of color patches, each series having plural different colors, the method comprising operating a printhead with each at least two of the series of color patches to transfer material, using heat from the printhead, from each of the series of color patches to a receiver sheet to form on the receiver sheet a respective color sub-image from each of the series of color patches, the respective sub-images forming a composite image that has gray level pixels in an overlap region formed by combining deposition of material from the color patches of each series of color patches so that a gray level pixel in the overlap region is formed by material from both the series of color patches.

In accordance with a fourth aspect of the invention, there is provided a method of thermal printing to form an elongated image on a receiver sheet wherein material is transferred from a donor sheet or ribbon having a repeating series of color patches to the receiver sheet, each series having plural patch areas of respective different colors, the method comprising defining a print length of an image to be printed; determining from said print length a number of series of color patches required to print the elongated image; and printing the image on the receiver using a printhead and the determined number of series of color patches, wherein adjacent series of color patches on the donor sheet or ribbon are used by the printhead to print an overlap area between two image area segments printed respectively using one of each of the adjacent series of color patches.

Figure 1:
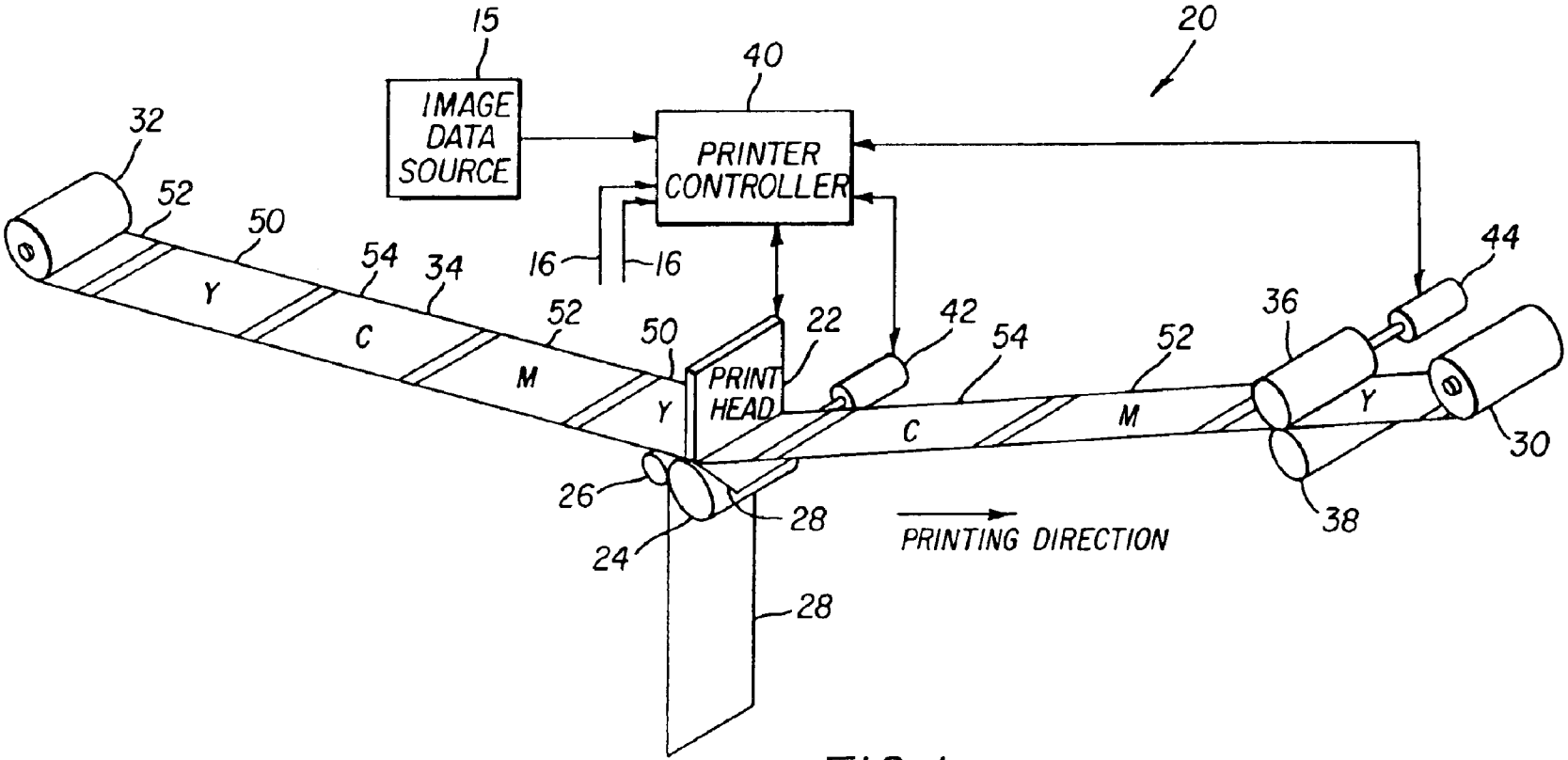
FIG. 1 (Prior Art)
FIG. 1 is a schematic view of a thermal printer as known in the prior art.

The drawings are not necessarily to scale.

DETAILED DESCRIPTION OF THE INVENTION

As is generally known and as used herein a typical dye donor web is used in a thermal printer and the web includes a repeating series of three different primary color sections or patches such as a yellow color section, a magenta color section and a cyan color section. Also, there may be a transparent laminating section after the cyan color section.

To make a color image using a thermal printer, respective color dyes in a single series of yellow, magenta and cyan color sections on a dye donor web are successively heat-transferred (e.g. by diffusion or sublimation), one on top of the other, onto a dye receiver sheet. Then, optionally, the transparent laminating section is deposited on the color image print. The dye transfer from each color section to the dye receiver sheet is done one line of pixels at a time across the color section via a bead of selectively used heating or resistor elements on a thermal printhead. The bead of heating elements makes line contact across the entire width of the dye donor web, but only those heating elements that are actually used for a particular line are heated sufficiently to effect a color dye transfer to the receiver sheet. The temperature to which the heating element is heated is proportional to the density (darkness) level of the corresponding pixel formed on the receiver sheet. The higher the temperature of the heating element, the greater the density level (or at least color dye transfer for that color) of the corresponding pixel. Various modes for raising the temperature of the heating element are described in prior art U.S. Pat. No. 4,745,413 issued May 17, 1988.

One known example of a color print-making process using a thermal printer will be described immediately below. This process will provide an understanding of operation of the invention in the context of making prints of a size corresponding to that of the dye donor patch of color. This known process is as follows.

1. The dye donor web and the dye receiver sheet are advanced forward in unison, with a yellow color section of the donor web moving in contact with the receiver sheet longitudinally over a stationary bead of heating elements in order to effect the line-by-line yellow dye transfer from the yellow color section to the receiver sheet. A web take-up spool draws the dye donor web forward over the bead of heating elements, and the pair of pinch and drive rollers drive the dye receiver sheet forward over the bead of heating elements. A platen roller holds the dye receiver sheet in a dye receiving relation with the dye donor web at the bead of heating elements.
2. Once the yellow dye transfer is completed, the platen roller is retracted from adjacent the printhead (or alternatively the printhead is moved away from the platen roller) to allow the pair of pinch and drive rollers to return the dye receiver sheet rearward in preparation for a second pass over the bead of heating elements.
3. Then, the platen roller is returned to adjacent the printhead, and the dye donor web and the receiver sheet are advanced forward in unison, with a magenta color section of the donor web moving in contact with the receiver sheet longitudinally over the bead of heating elements in order to a effect a line-by-line magenta dye transfer from the magenta color section to the receiver sheet. The magenta dye transfer to the dye receiver sheet is in exactly the same area on the receiver sheet as was subject to the yellow dye transfer and at pixel locations corresponding to where magenta dye is to be transferred to the receiver sheet. In many instances, magenta dye will be deposited directly over the yellow dye at certain pixel locations as is well-known for creating different colors.
4. Once the magenta dye transfer is completed, the platen roller is retracted from adjacent the printhead to allow the pair of pinch and drive rollers to return the dye receiver sheet rearward in preparation for a third pass over the bead of heating elements.
5. Then, the platen roller is returned to adjacent the printhead, and the dye donor web and the dye receiver sheet are advanced forward in unison, with a cyan color section of the donor web moving in contact with the receiver sheet longitudinally over the bead of heating elements in order to effect a line-by-line cyan dye transfer from the cyan color section to the receiver sheet. The cyan dye transfer to the dye receiver sheet is in exactly the same area on the receiver sheet as was subjected to the yellow and magenta dye transfers and at pixel locations corresponding to where cyan dye is to be transferred to the receiver sheet. In many instances, cyan dye will be deposited directly over the yellow dye, the magenta dye or on pixel locations that include both the yellow dye and magenta dye at certain pixel locations as is well-known for creating different colors.
6. Once the cyan dye transfer is completed, the platen roller is retracted from adjacent the printhead to allow the dye receiver sheet to be returned rearward in preparation for exiting the printer.
7. Then, the pair of pinch and drive rollers advance the dye receiver sheet forward to an exit tray.

Where a transparent overcoat is to be provided on the receiver sheet using a quad type patch set, an additional step is provided before causing the dye receiver to be forwarded to the exit tray. In this additional step, the transparent overcoat patch is positioned between the printhead and the receiver sheet and the printhead elements heated accordingly to transfer material from the patch having the transparent panel.

Referring to FIG. 1, there is shown a schematic representation of a full-color (typically a three color) thermal printer 20 which represents the prior art but may be modified in accordance with the teachings herein to be used to practice the present invention. The thermal printer 20 comprises a printhead 22, a transport platen 24 and a clamping roller 26 for transporting a receiver (printing media) 28, a take-up spool 30, and a supply spool 32 for a dye-donor film 34, a drive roller 36 and the clamping roller 38 for the dye-donor film 34, the printer controller 40 and first and second motors 42 and 44, respectively. The motor 42 is a conventional stepper motor and the motor 44 is conventionally controlled torque motor. The dye-donor film 34 is comprised of a repeating series of dye patches coated on a clear film of polyethylene terephthalate. The first color dye patch 50 is yellow (Y), a second dye color patch is magenta (M), and a third color dye patch 54 is cyan (C). The thermal printhead 52 comprises a series of heating elements arranged in a row directed in the main-scan direction of printing. The receiver and dye-donor film during printing are moved incrementally, line by line, in the slow-scan direction.

The printer controller 40 is coupled by first, second and third outputs to the motors 42 and 44 and to the printhead 22, respectively. The motor 42 rotates the transport platen 24 to advance the receiver 28. The motor 44 rotates a drive roller 36 to advance the dye-donor film or ribbon 34.

In operation, the thermal printer 20 functions under the direction of the printer controller 40. The printer controller 40 is a microprocessor-based control system. The printer controller 40 receives an image data signal from a conventional digital image source, such as a computer, workstation, digital camera or other source of digital data, and generates instructions for the printhead 22 in response to the image data. Additionally, the printer controller 40 has inputs 16 for receiving signals from various conventional detectors (not shown) in the thermal printer 20 which provide routine administrative information, such as a position of the receiver 28 a position of the dye-donor film 34, and the beginning and end of a print cycle, etc. The printer controller 40 generates operating signals for the motors 42 and 44 in response to said information.

The printhead 22 performs a printing operation by selectively heating and thereby transferring spots of dye from the dye-donor film 34 onto the receiver 28. The system of dye deposition in thermal printing is well known in the prior art and an example is provided in the description above. The creation of a full-color image requires the deposition of three separate images superimposed on each other, using yellow, cyan and magenta dyes successively from a predetermined dye triad.

Figure 2:
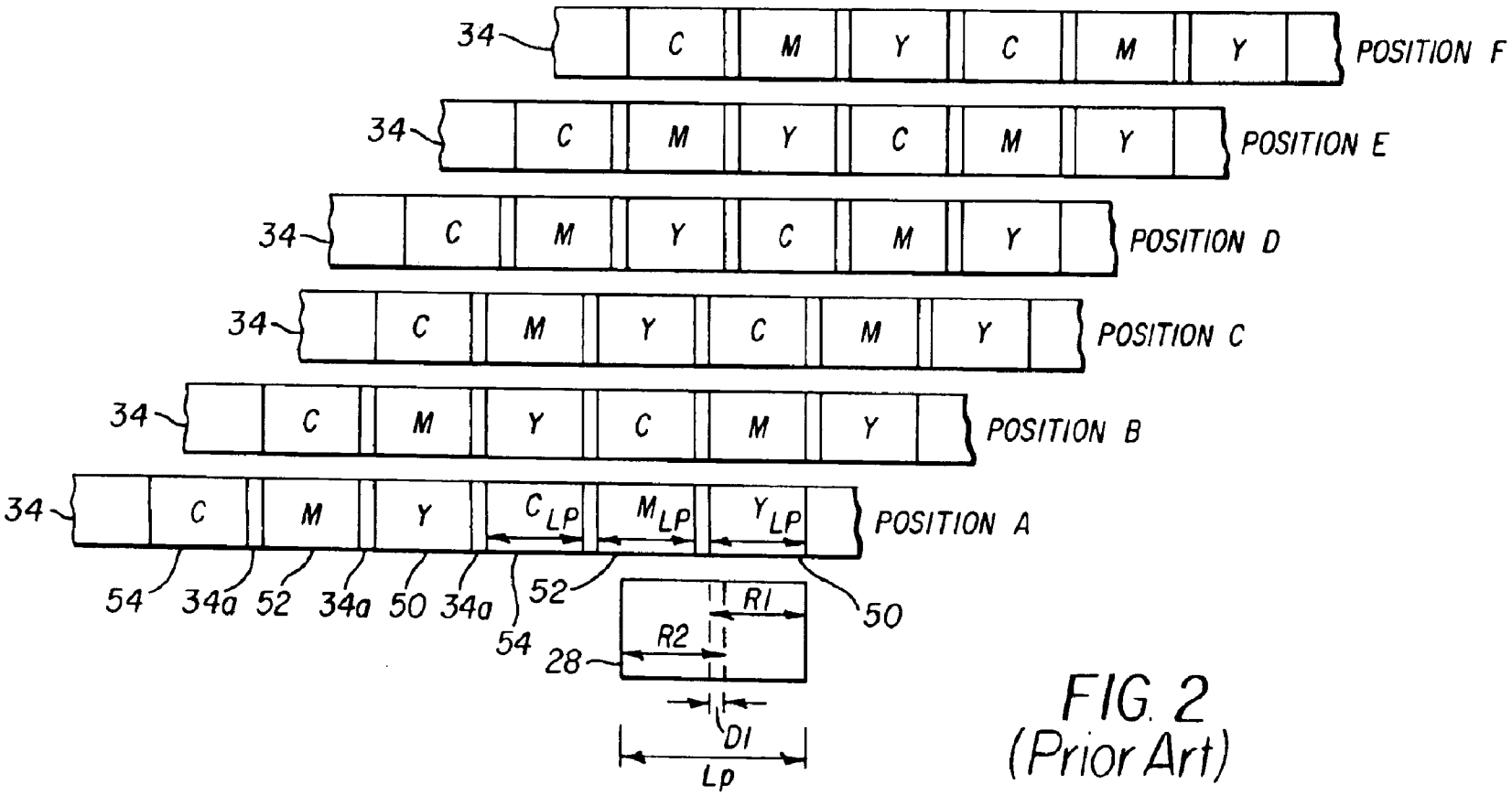
FIG. 2 (Prior Art)
FIG. 2 is a symbolic representation of a receiver that receives an image and the series of positions of a portion of the dye donor film used to produce the image thereon in accordance with the prior art wherein at least two color patches of the same color are used to record a larger image on the receiver.

Referring now to FIG. 2, there are shown a receiver 28 and a portion of the dye-donor film 34 in a series of schematic relative positions to illustrate certain features of the thermal printer 20 of FIG. 1. The portion of the dye-donor film 34 is shown in the series of positions, Position A through Position F, with each position illustrating how the dye-donor film 34 is oriented relative to the receiver 28 in order to produce a particular portion of a desired image.

The dye patches 50, 52 and 54 are coated on to the dye-donor film 34 in a gravure process that produces the dye patches each with a length Lp as is predetermined based on the nominal size of the expected regular prints to be produced by the thermal printer. The film 34 comprises a repeating sequence of yellow, magenta and cyan dye patches 50, 52 and 54 respectively which are each separated by a non-color portion or nontransferable separation of film 34*a*. If we assume for example that the nominal size of a print to be produced by the printer 20 is 3½ by 5 inches, then the printhead 22 can be made five inches long and be the full width of the patch material and the length Lp of each patch in this example would be 3½ inches long or slightly longer. This allows for higher productivity by providing for a printhead that prints in the fast scan direction while the shorter dimension is the slow scan direction in which the receiver moves.

In order to produce a larger size of print such as that of a 5 by 7 inches size print, it is clear that this represents a doubling in size of the nominal receiver. The situation for producing a larger size print according to the prior art and which bears similarities to that of the present invention is illustrated in FIG. 2. The receiver 28 has a length Lr in the slow scan direction that is greater than the length Lp of the dye patches 50, 52 and 54 on the dye donor film 34. The receiver 28 is comprised of two regions R1 and R2 a portion of which regions overlap and the overlap region is shown as being between the dashed lines. Each of the regions R1 and R2 has a length that is no longer than the length Lp of one of the dye patches 50, 52 and 54. The regions R1 and R2 are shown overlapping by a distance D1.

In a typical print cycle, the printer controller 40 of FIG. 1 first directs the motor 42 of FIG. 1 to advance the receiver 28 to a starting location. Typically, this starting location is determined as a point where a conventional sensor (not shown) senses a blocking of light from a light source (not shown) by presence of a leading edge of the receiver 28. The motor 42 then advances the receiver 28 a predetermined number of steps beyond the starting location. The motor 44 of FIG. 1 advances the dye-donor film 34 so the leading edge of the first one of the yellow dye patches 50 is positioned adjacent a leading edge of the receiver 28 (shown schematically as position A in FIG. 2). Then a first line of printing begins. The printing takes place on a line-by-line basis with the motor 42 advancing the receiver 28 and the dye-donor film 34 a predetermined incremental distance between successive lines of printing.

The motor 42 incrementally advances the receiver 28 and the dye-donor film 34 throughout the generation of a first color (yellow) image on the first region R1 of the receiver 28. A constant tension is maintained on the dye-donor film 34 by the rollers 36 and 38 and the motor 44. At the completion of the first color image, motor 42 reverses and rotates the transport platen 24 in a counter-clockwise direction until the leading edge of the receiver 28 has been withdrawn beyond the starting position. The motor 42 is then driven in the forward or clockwise direction until the leading edge of the receiver 28 is advanced to a position where printing of a second color image is to begin. The motor 44 advances the dye-donor film 34 so that a leading edge of a first one of magenta dye patches 52 is positioned (Position B) adjacent the leading edge of the receiver 28. The printing process is repeated to replace a second color (magenta) image on to the first region R1 of the receiver 28. Similarly, a third color (cyan) image is printed onto the first region R1 of the receiver 28 (Position C).

At the completion of printing of the three image colors (yellow, magenta and cyan), a first full-color composite sub-image (first sub-image) has been produced on the first region R1 of the receiver 28.

After the first sub-image in region R1 is formed, the leading edge of the receiver 28 is returned to the starting position. The receiver 28 is then advanced so that a leading edge of the region R2 of the receiver 28 is aligned with the printhead 22. Then a leading edge of a second one of the yellow dye patches 50 is advanced to the printhead 22. The relative position of the receiver 28 and the dye-donor film 34 at this point is shown in Position D.

Printing of a first color (yellow) of a second sub-image in region R2 then begins. In a preferred embodiment of the thermal printer 20, the printing of the second sub-image begins in a region of the receiver 28 on which a partially complete segment of the first sub-image is already formed. In other words, there is an overlapping of segments of the first and second sub-images on a portion of the receiver 28 where the regions R1 and R2 overlap.

This process is repeated for each of the two remaining colors, magenta and cyan (see Positions E and F). After deposition of the images for the three colors of dye onto the second sub-image, a complete image is present on the receiver 28.

In order to produce an image that is not visually objectionable, it is necessary to accurately align the first and second sub-images. As noted in the aforementioned prior art, there may be some misalignment between the sub-images and certain steps described therein may be used to minimize the visibility of such misalignments to the unaided human eye. In the prior art, image data is assigned to each of the rows of a line with a probability that varies as a function of the distance of a line from the boundary line. For example, the first line in the overlap region has a 100 percent probability of printing the pixel assigned to be printed on that line whereas subsequent lines have a correspondingly lower probability of being printed using the first triad of color dye patches. A printer controller selects at random, which rows of a particular line are to be left blank. When the overlap region is to be printed using the second triad of color dye patches, image data is assigned to the overlap segment of a data field that corresponds to blank areas of the data field used for printing when employing the first triad of color dye patches.

Figure 3:
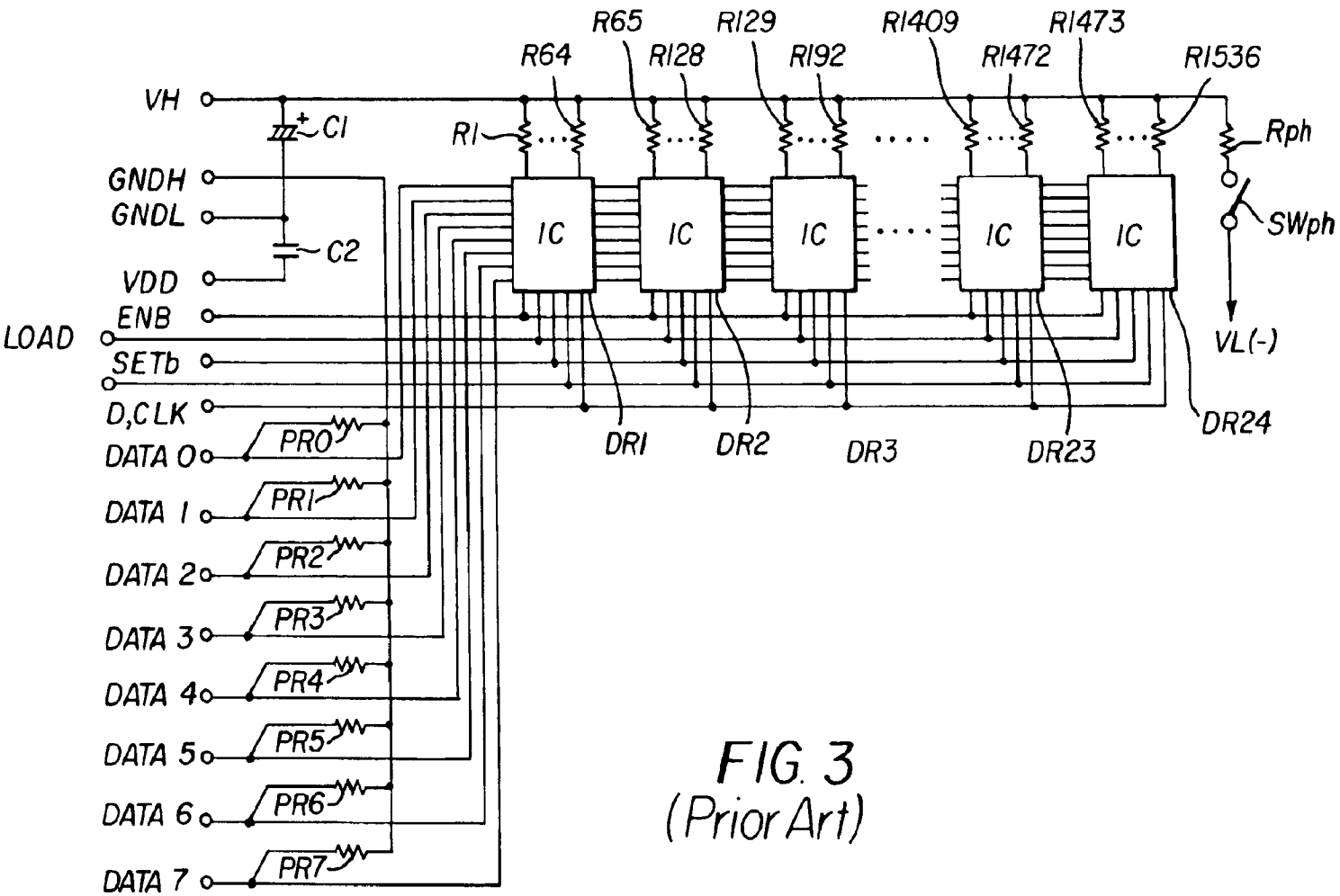
FIG. 3 (Prior Art)
FIG. 3 is a schematic representation of a thermal printhead and associated circuitry known in the prior art and which may be used for forming an image in accordance with the invention.

FIG. 3 illustrates schematically a configuration of the thermal printhead that may be used in accordance with the present invention. In FIG. 3, reference symbols R 1 to R 1536 denote 1536 printing heater elements disposed in the thermal head. Each of these thermal heater elements is formed of a resistor which generates heat when being electrically energized. The thermal head heaters R 1 to R 1536 are arranged in a line in a main scan direction perpendicular to the slow scan direction in which the print paper is fed. One end of each resistor serving as a thermal head heater element is connected in common to a line for supplying the power supply voltage VH.

Reference symbol Rph denotes a heater for pre-heating the paper and is optional. A switch SWph shown as a mechanical switch but actually is preferably a transistor switch controls the supply of current to the pre-heater. The pre-heater Rph and the switch SWph are connected in series between the power supply VH and the power supply VL. Description of the pre-heater may be found in U.S. Patent Application Publication No. 2001/0033320 published in the name of Sugiyama et al.

Reference numerals DR1 to DR 24 denote printer drivers (ICs) for driving the thermal head heaters R 1 to R 1536. Each driver is responsible for controlling sixty four thermal head heaters of thermal head heater elements R 1 to R 1536, the total of 1536 (=64×24) thermal head heater elements being driven by the 24 drivers.

The 24 drivers DR1 to DR 24 are cascaded via data lines so that one line of imprint data can be sent into the drivers R 1 to R 24 by shifting print data DATA0 DATA7 from one driver to the following driver. The drivers DR1 to DR 24 include switches SW1 to SW 1536 (see FIG. 4) for controlling the operation of electrically energizing the thermal head heaters R 1 to R 1536. As noted above, although the switches are shown schematically as mechanical switches it is preferred to have the switches be controlled using transistors.

Terminals through which print data DATA0 through DATA7 are supplied maybe respectively connected to a ground terminal GNDL via pull-down resistors PR0 to PR7.

Figure 4:
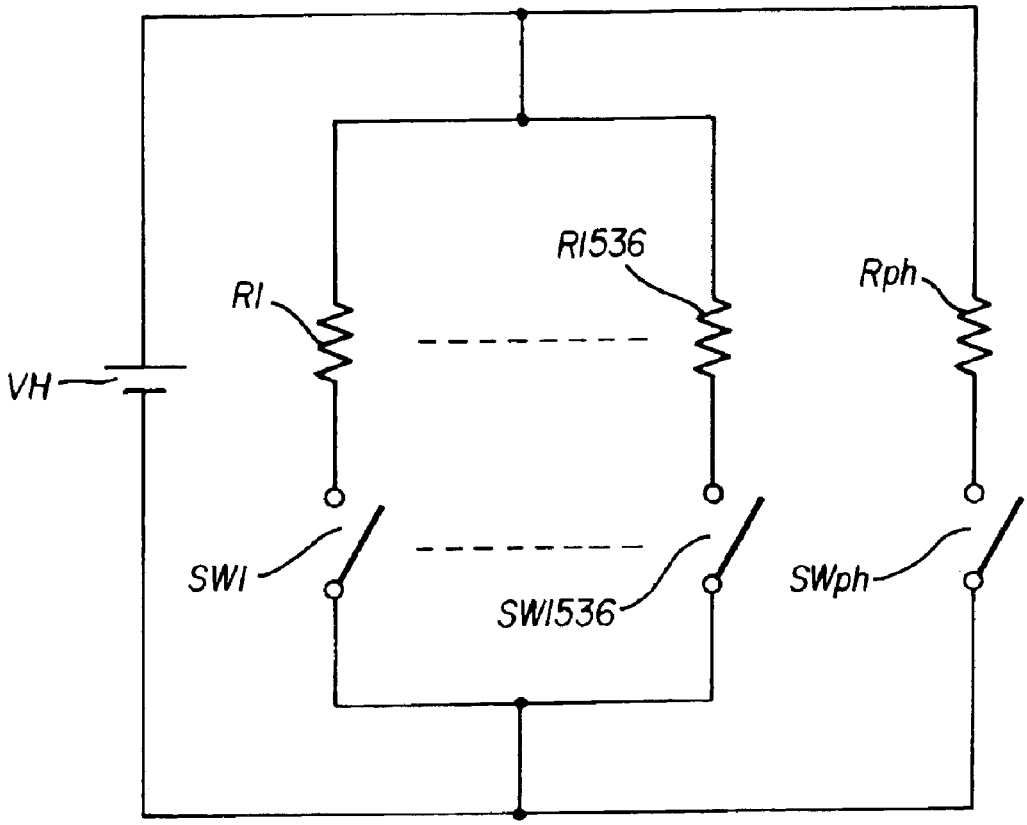
FIG. 4 (Prior Art)
FIG. 4 is an additional schematic representation of the thermal printhead of FIG. 3 and illustrating very schematically switching devices associated with each resistive element of the thermal printhead.

With reference to FIG. 4, the switches SW1 to SW 1536 are disposed in the drivers DR1 to DR 24 such that each driver includes sixty four switches, and each thermal head heater element R 1 to R 1536 is connected in series to one corresponding switch, and each series connection of one thermal head heater element and one switch is connected between the positive terminal of the power supply VH and the negative terminal (ground GNDH) thereof. In this configuration, some of the thermal head heater elements R 1 to R 1536 are selectively connected to the power supply voltage VH when there is selective turning on of the corresponding switches of switches SW1 to SW 1536. Those heating elements selectively connected to the power supply voltage VH generate heat in accordance with and in amounts related to the enablement time they are so connected during a respective line period. That is, any of the 1536 thermal head heaters R 1 to R 1536 can be separately turned on by closing the respective one of the 1536 switches SW1 to SW 1536, and record a pixel or spot of color as the respective thermal head heater element generates heat to cause dye to sublimate or diffuse from the respective color patch to the receiver.

It will be understood that the numbers provided above are exemplary and that through higher level integration, one integrated circuit may contain all the driver circuitry for several thousand switches.

Figure 5:
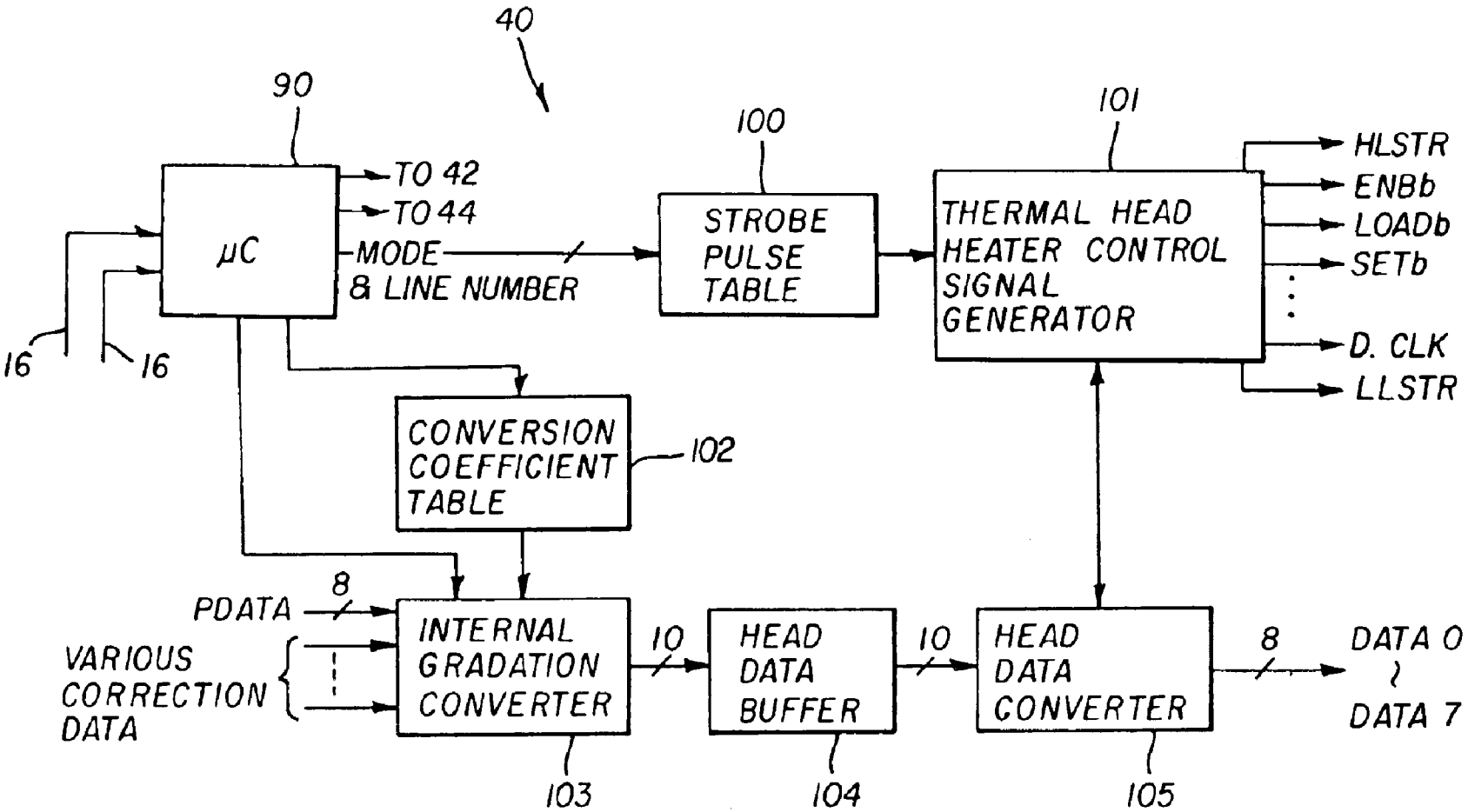
FIG. 5 is a block diagram of a controller for providing the various signals operating on the thermal printhead of FIG. 3 in accordance with the invention.

FIG. 5 illustrates a circuit configuration of the circuit or printer controller 40 for generating various control signals and imprint data signals. In FIG. 5, reference 100 denotes a strobe pulse table which defines a pulse pattern of the strobe signal HLSTR serving as a reference signal according to which the energization of thermal head heaters R 1 to R 1536 are controlled depending upon the printing mode. A strobe pulse table outputs a pulse pattern in response to a print mode signal MODE specifying the printing mode in which one of colors of yellow, magenta, cyan and optionally a transparent overcoat (where a quad patch is used). In the enlarged print mode the print mode signal MODE also is changed in accordance with the line number being printed as will be discussed further below.

Reference number 101 denotes a thermal head heater element control signal generator for generating various control signals (enable signal ENBb, load signal LOADb, set signal SETb, high-level strobe signal HLSTR, low-level strobe signal LLSTR, and clock signal DCLK). The strobe pulse table 100 in the thermal head heater element control signal generator 101 forms signal generating means for generating a high-level strobe signal HLSTR serving as a reference signal and controlling the operation of energizing the thermal head heater elements depending upon the printing mode selected from a plurality of printing modes in which respective colors are printed.

Reference number 102 denotes a conversion coefficient table which describes conversion coefficients used in conversion of the gradation of image data PDATA to be printed. Reference number 103 denotes an internal gradation converter for converting 8-bit image data PDATA input from a data source with various correction data in the conversion coefficients into a 10-bit internal gradation data. The correction data may correct for non-uniformity of the recording elements which may be part of a predetermined factory calibration in accordance with well-known techniques. Reference number 104 denotes a head data buffer for temporarily storing the converted internal gradation data. Reference number 105 denotes a head data converter for converting the 10-bit internal gradation data stored in the head data buffer 104 into 8-bit data DATA0 to DATA7 to be sent to the printer drivers. It will be understood that the number of data bits used to print a particular pixel may be more or less than eight bits.

A microcomputer 90 controls the various motors, generators, converters and tables forming printer controller 40 which may be integrated on the microcomputer or comprises separate integrated circuit components. A microcomputer would be programmed to provide the various signals as required in accordance with routine programming skills.

Figure 6:
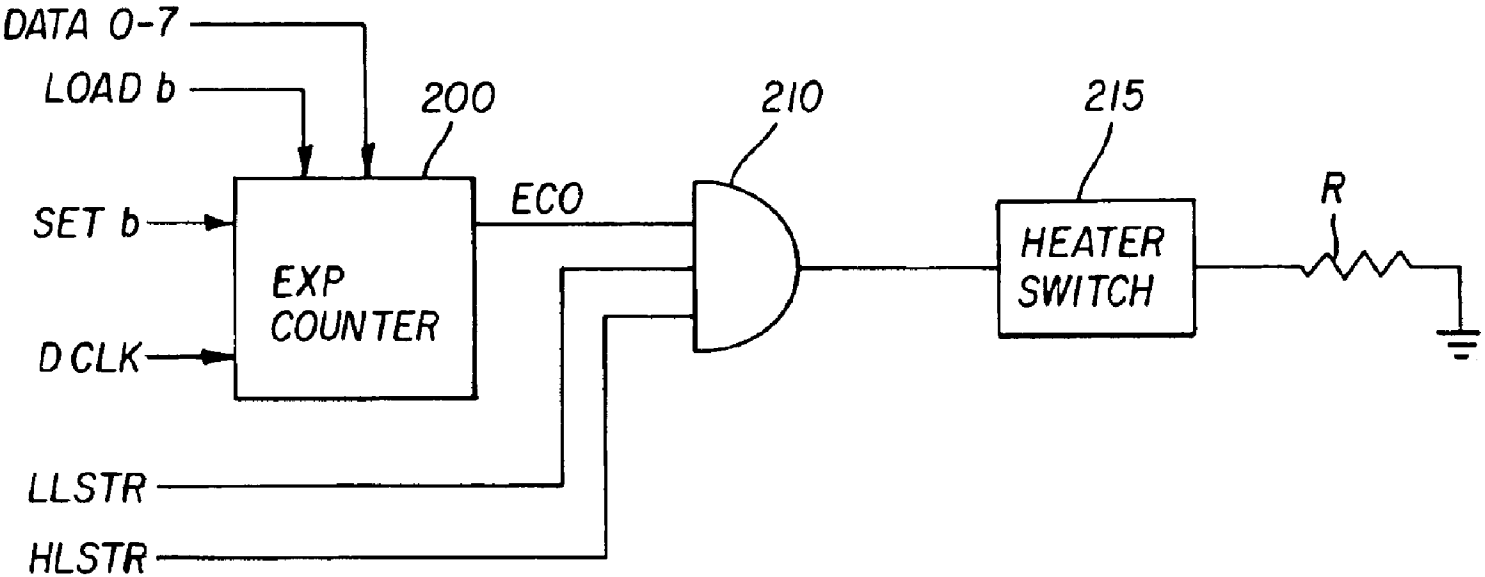
FIG. 6 is a circuit for enabling each recording element of the printhead in accordance with the invention.

Within each printer driver IC (DR1 . . . DR24) and with reference now to FIG. 6, there may be provided associated with each recording element an exposure counter 200 into which data lines D0–7 are input. Upon establishment of a load signal LOADb, the count value established by the image data signals on lines D0–7 are stored in a first register in the counter. In response to the SETb signal, the count value in the first register is compared with a count in a second register that counts clock signals input on the line DCLK. As the clock signals are counted, the count in the second register is incremented and when there is an equality of count values in both registers a signal is provided on the line ECO which is one input to an AND gate 210. Additional inputs to the AND gate 210 are the strobe signals HLSTR and LLSTR. When all signals input to the AND gate are logic high the heater switch 215, which is one of the switches shown in FIG. 4 (SW1–SW 1536), is closed to provide electrical energy to the resistor heating element to heat the resistive recording element R which is one of the thermal head heaters.

Figure 7A:
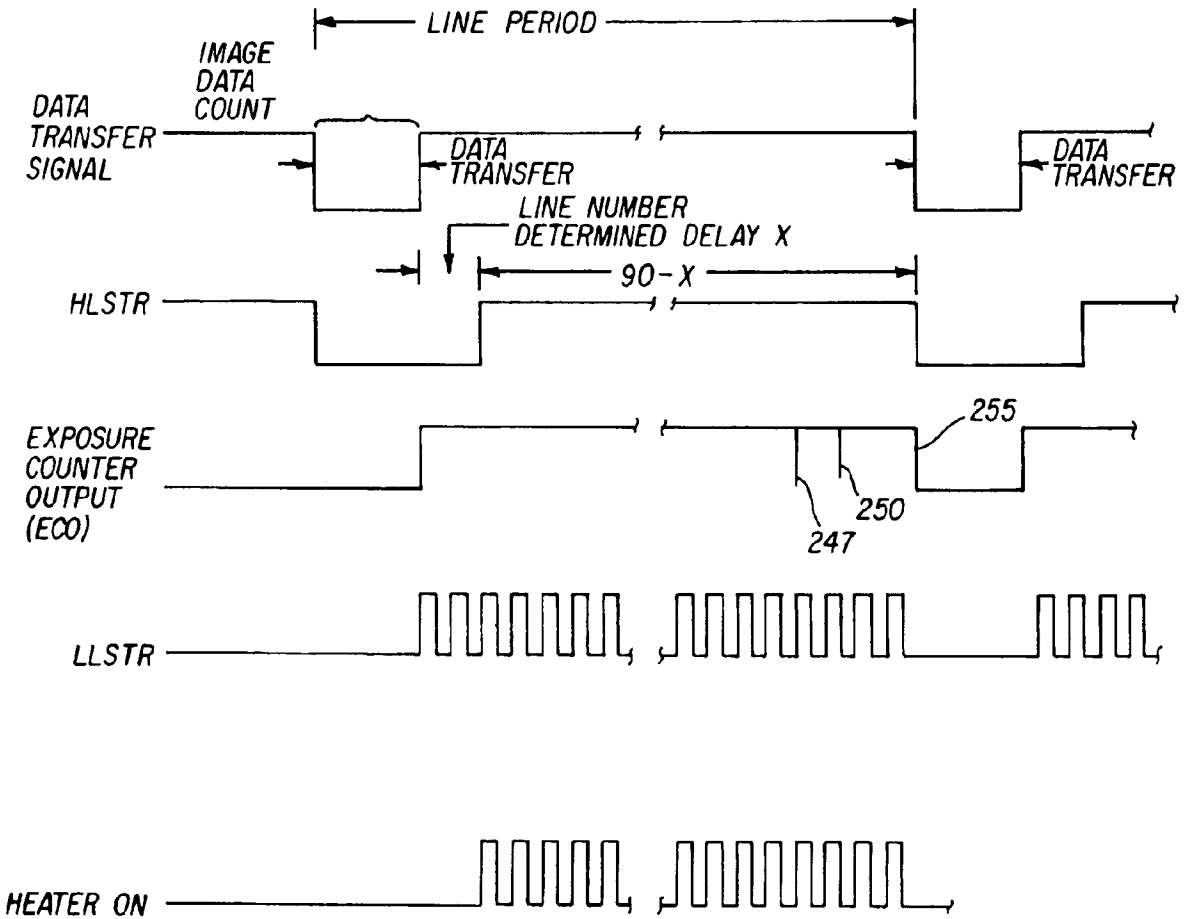
FIGS. 7A and 7B are timing diagrams illustrating various signals for operating the printhead of FIG. 3 and their relative relationship in the time domain in accordance with the invention.
Figure 8:
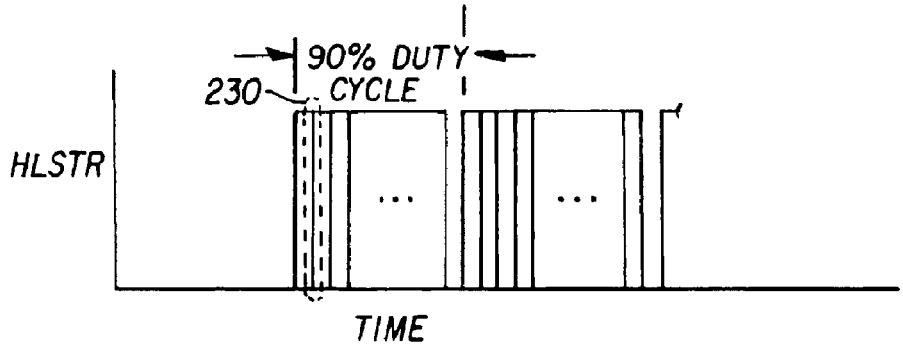
FIG. 8 is a timing diagram illustrating a high-level strobe signal (HSTR) that is used to determine duration of enablement of a thermal recording element on the printhead of FIG. 3 and in accordance with the invention.
Figure 9:
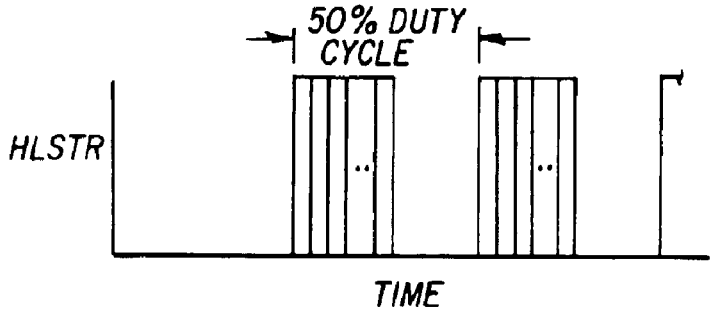
FIG. 9 is a timing diagram similar to that of FIG. 8 but illustrating the high-level strobe signal with a shorter duty cycle.
Figure 10:
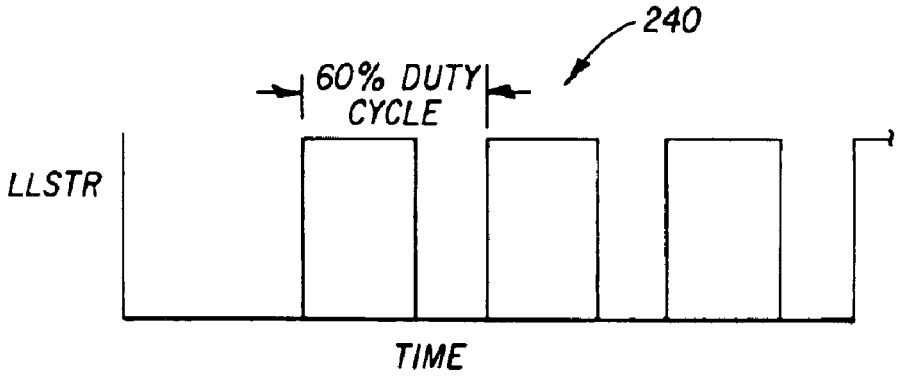
FIG. 10 is a timing diagram showing an expanded portion of the high-strobe signal of FIG. 8 but illustrating a group of low-level strobe signals that are effectively enveloped by the high-level strobe signal.

FIG. 7A illustrates an example of the waveforms which are used in control of recording image data. The control of transmission of data through the drivers and latching thereof is controlled by the signals DCLK, SETb and LOADb signals as is well known. The high-level strobe signal HLSTR is shown to have a duty cycle represented by a delay subsequent to ending of the data transfer period. The period represented by the data transfer signal is of sufficient duration to allow data to be serially transferred to all the count registers on the print head so that within each count register there is established a count number representing the time for recording the respective image data by that recording element during that particular line period. A delay is established between the start of the high-level strobe signal HLSTR and the end of the data transfer period. The length of this delay establishes a duty cycle for the exposure period. A duty cycle of 90 percent will be used consistently for print or data lines 1 through 1006 where the mode is that of forming a print of 3½ inches long. When in the mode for forming larger images, such as the 7 inch print mode, and when recording using the first triad of color patches, the 90 percent duty cycle will be used consistently for data lines 1 through 922. For each subsequent line; i.e. lines 923 through 1006, the duty cycle will gradually decrease preferably linearly. In FIG. 8 there is an illustration of the high-level strobe signal HLSTR 230 having a 90 percent duty cycle. In FIG. 10 there is an illustration of the composition 200 of each high-level strobe signal HLSTR and showing same as being comprised of or in effect forming an envelope for a series of low-level strobe signals LLSTR 240. In the example illustrated in FIG. 10, the low-level strobe signals each has a duty cycle of 60 percent which in this embodiment would be consistent for all recording lines wherein only the duty cycle for the high-level strobe signal changes. Examples of values of a period for a low-level strobe pulse is 45 microseconds for a sixty percent duty cycle wherein pulse on time for such LLSTR is 27 microseconds. Several hundred low-level strobe pulses may be present within a single high-level strobe signal HLSTR at the 90 percent duty cycle for the high-level strobe signal.

Figure 11:
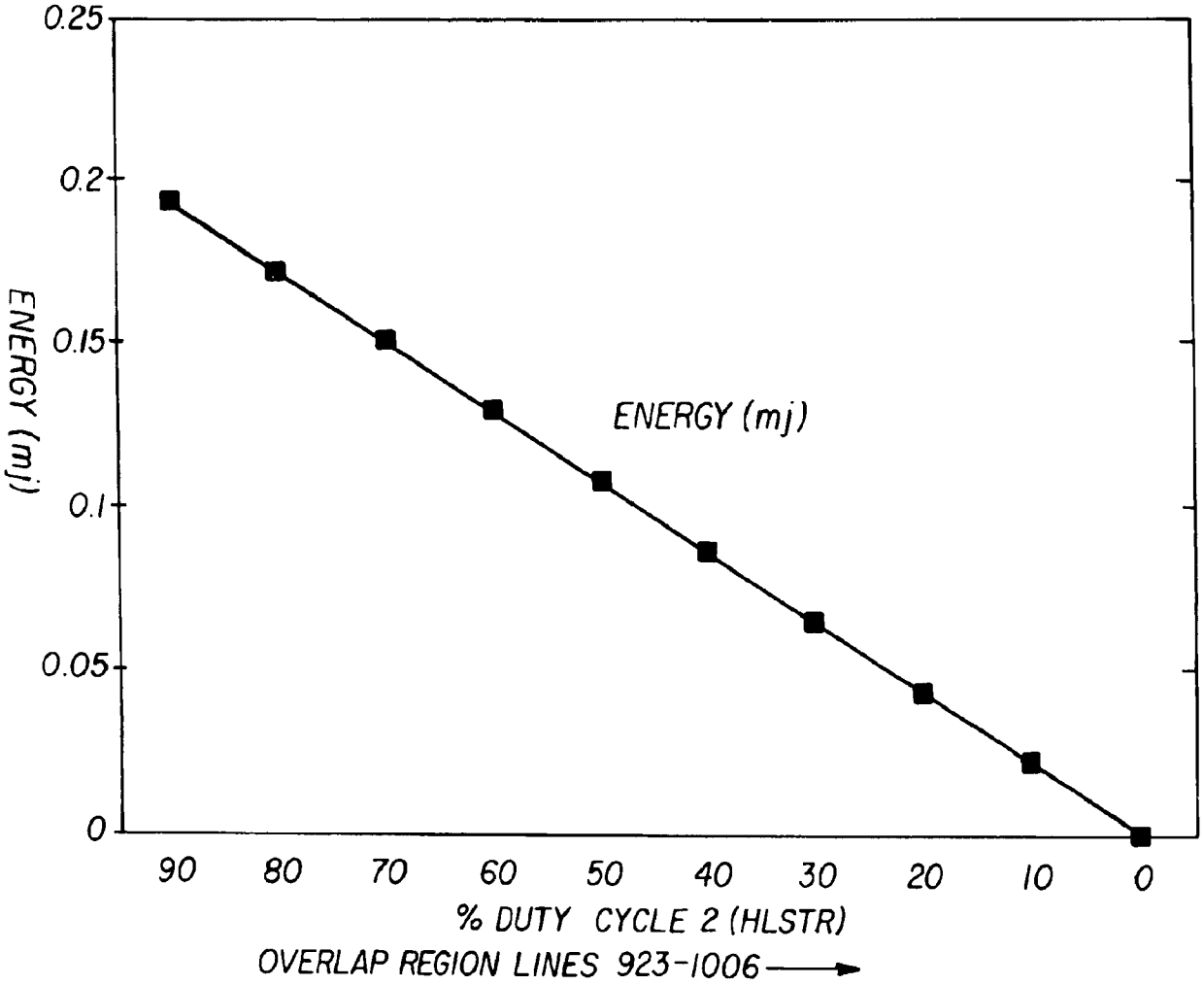
FIG. 11 is a graph illustrating a relationship between energy and percent duty cycle employed for a high-level strobe signal HSTR in accordance with the embodiment of FIGS. 8 through 10 and shows that energy to a recording element enabled by a predetermined image data signal will provide different energy to that recording element in accordance with the duty cycle of the high-level strobe signal.

During recording in the overlap region (lines 923–1006) the duty cycle for the high-level strobe signal HLSTR during recording using the first triad of color patches reduces linearly as illustrated in FIG. 11 and thus the number of low-level strobe signals present within a single high-level strobe signal linearly decreases with the line number since the period and duty cycle for the low-level strobe signal LLSTR is not changed from line to line in this first embodiment.

When the second triad of color patches is also used in the recording of the enlarged image the duty cycle for the high-level strobe signal HLSTR is 0 percent for lines 1 through 922. In the overlap region (lines 923–1006) the duty cycle for the high-level strobe signal HLSTR increases linearly and thus the number of low-level strobe signals LLSTR present within a single high-level strobe signal HSTR increases linearly with the line number again because the period and duty cycle for the low-level strobe signals LLSTR in this embodiment is not changed from line to line.

Figure 7B:
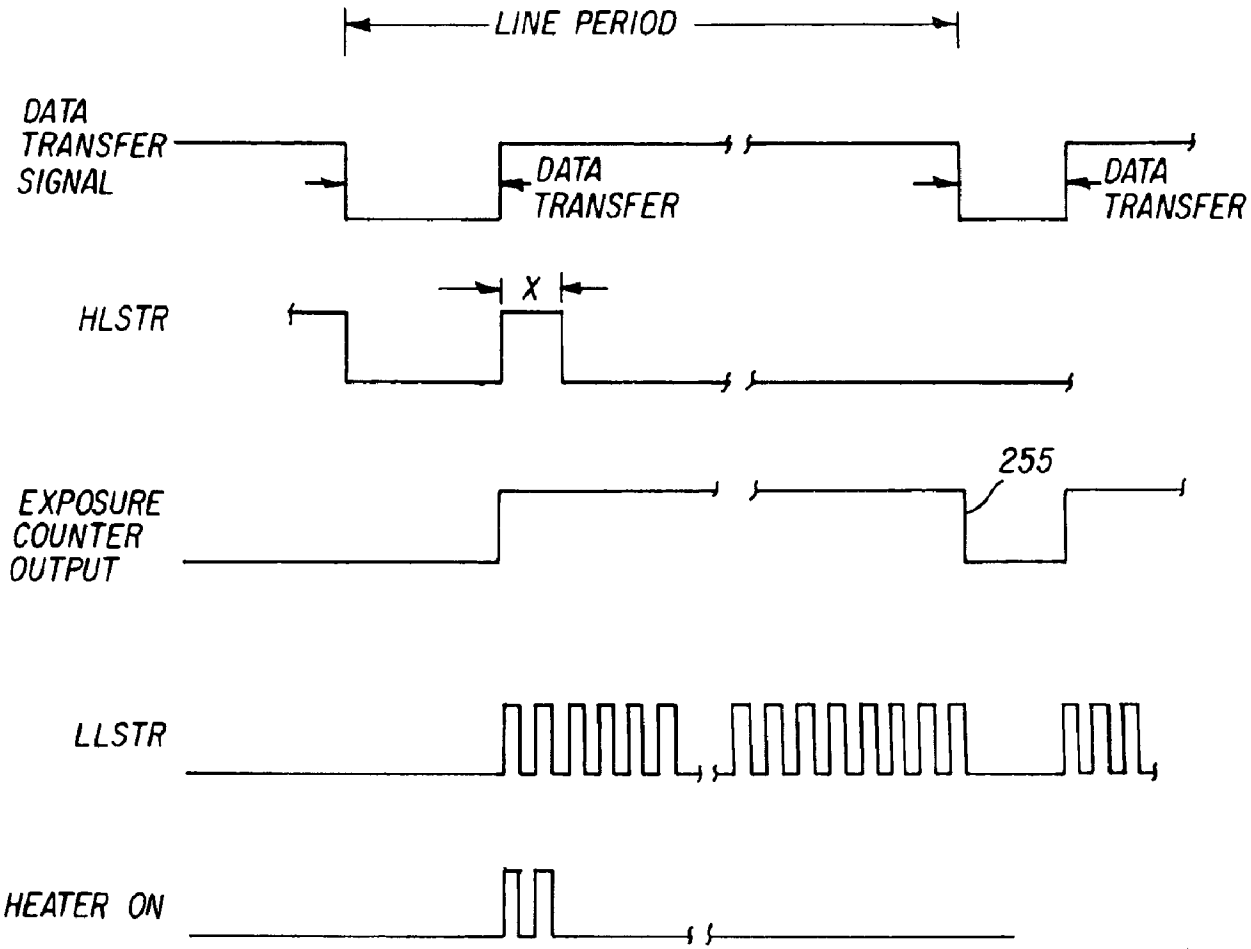

With reference to FIG. 7B, an example is provided of the signals during recording in the overlap region when recording the second triad of color patches. The data input to the exposure counter for this recording element is identical to that input for this line number and color patch when the first triad of color patches was printed. However, there is no delay following the end of the data transfer period and the duration of the high-level strobe signal HLSTR is essentially complementary to the duration of the high-level strobe signal used during recording of the same line number and color patch during recording of the first triad of color patches. By complementary it is meant that where the duty cycle for a particular recording line is 90–x for the high-level strobe signal during recording using a color patch, for example cyan, in the first triad of color patches the duty cycle will be x for the high-level strobe signal using the counterpart color patch, cyan, in the second triad of color patches. Thus as maybe seen in FIG. 7B, where the value of the duty cycle x is much smaller than 90–x, the heater on time will be relatively short due to the ANDing logic operation.

Figure 15:
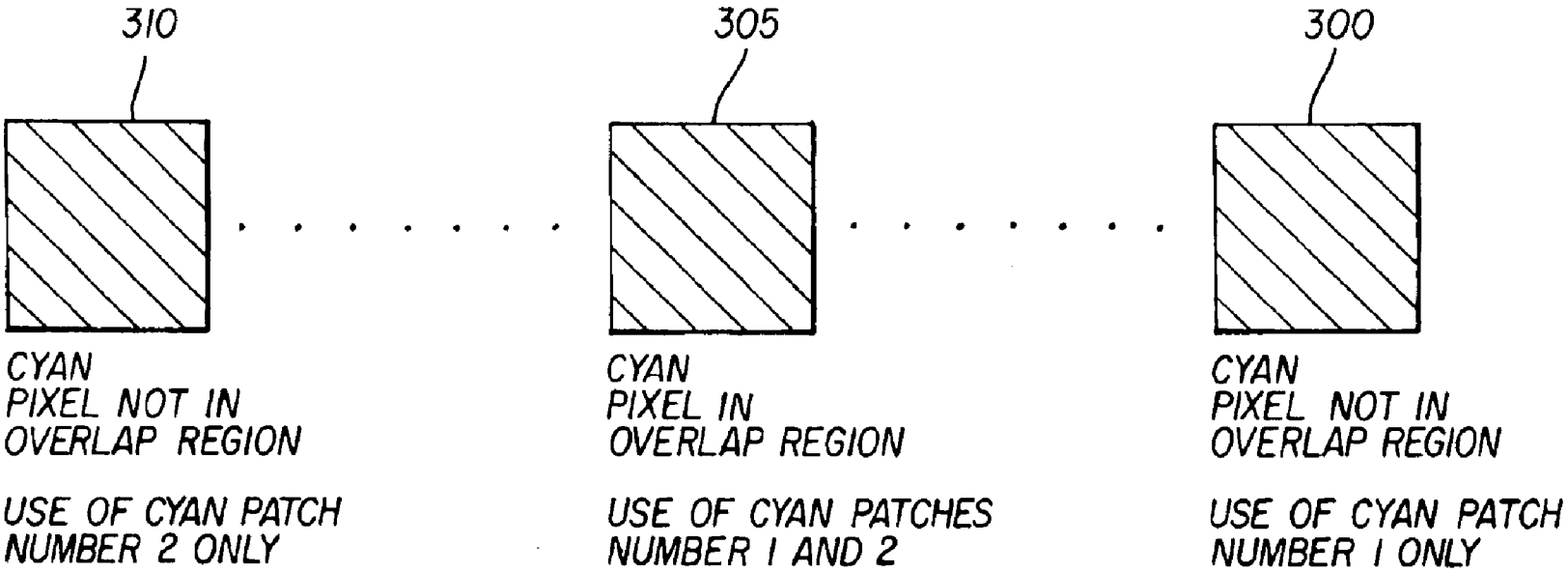
FIG. 15 is an illustration of three pixels formed on an elongated receiver sheet according to the invention including one pixel formed using one color patch from a first triad of color patches, a second pixel formed in an overlap area and formed using two color patches, the one color patch and a second color patch from a second triad of color patches used to record on the receiver sheet, and a third pixel formed using the second patch.

With reference to FIG. 15, there are shown three pixels recorded by the printhead on the receiver sheet using the invention and for printing during the enlarged recording mode wherein two triads of color patches are used. For simplicity, consider the case where the pixel to be formed at each of the three locations is to be formed in the cyan color. It will be understood also that in this example the pixels to be formed will each be of the same density, say for example 128 of a possible selectable range of 0 through 255. That is, the printhead is capable of printing gray levels dependent upon the data to be recorded in a particular one of the gray levels from 0 through 255. Pixel number 300 will be recorded using the cyan color patch of the first triad only, i.e. this pixel is in the region of lines 1 through 922. The printhead recording element for recording this pixel will be driven with a predetermined high-level strobe signal HLSTR having a duty cycle of 90 percent. As noted above, within this high-level strobe signal there are a series of low-level strobe signals LLSTR having a duty cycle of sixty percent. The duration of enablement of energy for recording pixel 300 will be dependent upon the density for recording the particular color at that location. The second triad of color patches will not be used at all for recording pixel 300.

For pixels in the overlap region such as pixel 305, the printhead recording element for recording this pixel will be actuated for recording a portion of this pixel using the cyan color patch of the first triad of color patches and then subsequently used for recording the next portion of this pixel using the cyan color patch of the second triad of color patches. The density recorded for each portion of this pixel will be dependent upon the line number. Since the overlap region in this example is defined between lines 923 and 1006, the portion in terms of density of the pixel recorded by the color patch of the first triad will be greater for pixels on line numbers closer to 923 and thus there will be less dye transferred for such pixels from a color patch in the second triad of color patches.

Figure 16:
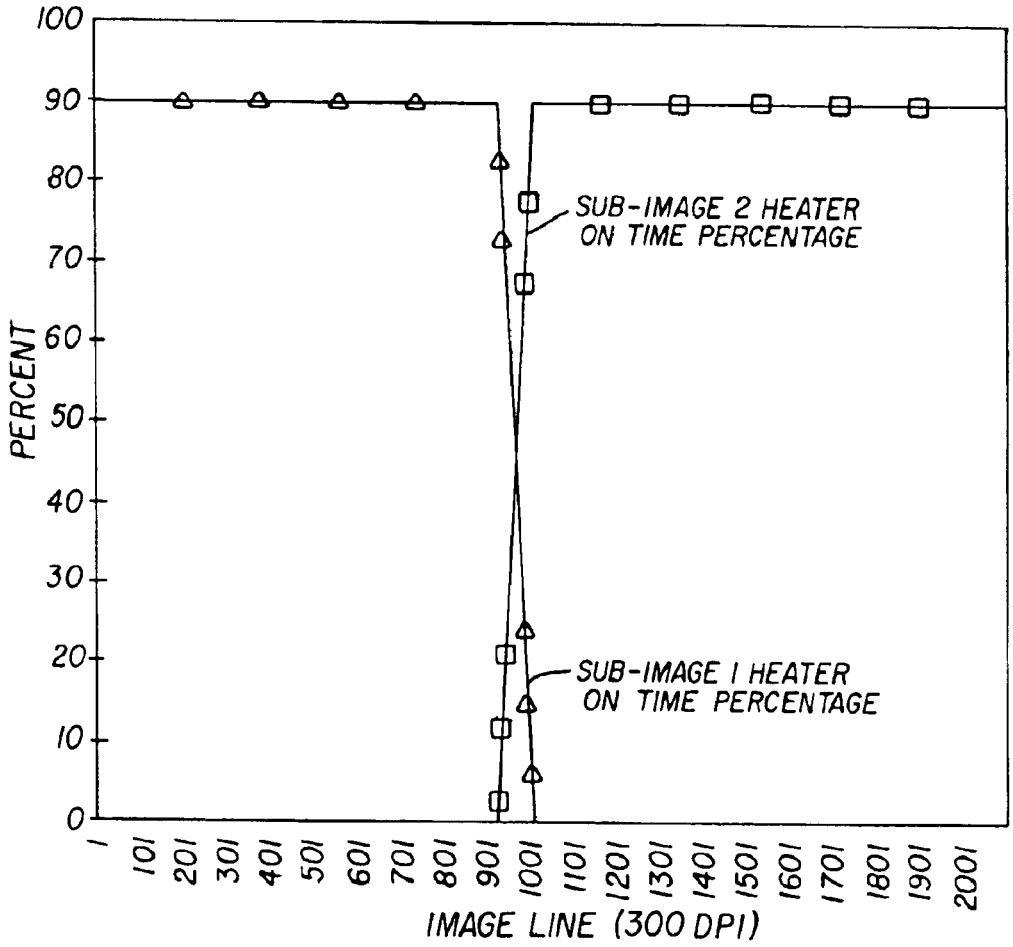
FIG. 16 is a graph illustrating a recording elements heater on-time percentage when recording sub-image 1 and sub-image 2, the two sub-images forming an elongated image.

With reference to FIG. 16, the portion in terms of density of the pixel recorded by the color patch of the first triad will be less for pixels on line numbers closer to 1006 as there will be more dye transferred for such pixels from a same color of color patch in the second triad of color patches. In this overlap region the high-level strobe signal changes from line to line for both the recording using the first triad of color patches and for recording using the second triad of color patches. In any event, the number of low-level strobe signals for recording the pixel 305 will be about the same as that for recording the pixel 300 except that the recording will be done at two different times using the two different color patches to provide the same density result of 128.

For a pixel such as pixel 310 of FIG. 15 in the non-overlap area of lines 1007 through 2101 of the receiver sheet this pixel will be recorded entirely using the cyan color patch of the second triad of color patches without any contribution at all from a color patch of the first triad of color patches.

It will be noted that the overlap region has purposefully been defined as not passing through the center of the print. Since this region may not be as well recorded as that using a single triad of color patches it is preferable to avoid placing same in the middle of the print. In this example the overlap region is approximately slightly more than one-quarter of an inch long in the direction of the advancement of the receiver sheet.

Figure 12:
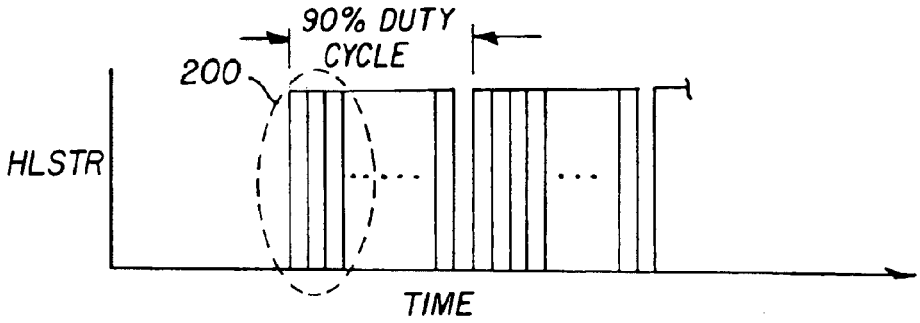
FIG. 12 is a timing diagram similar to that of FIG. 8 but which may be used in a second embodiment of the invention.
Figure 13:
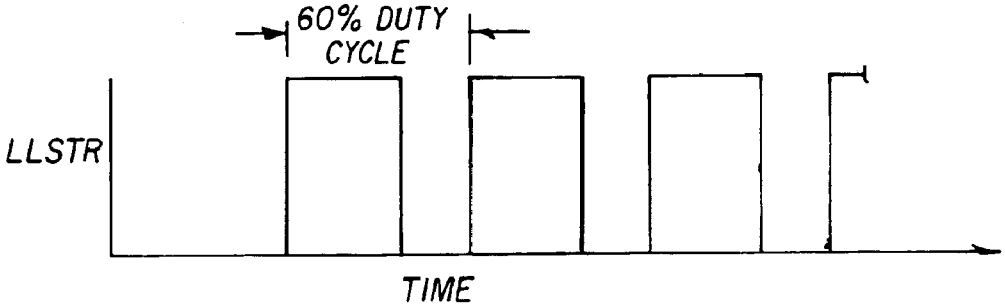
FIG. 13 is a timing diagram similar to that of FIG. 10 and showing an expanded portion of the high-level strobe signal of FIG. 12 but illustrating a group of low-level strobe signals that form a part of the high-level strobe signal of FIG. 12.
Figure 14:
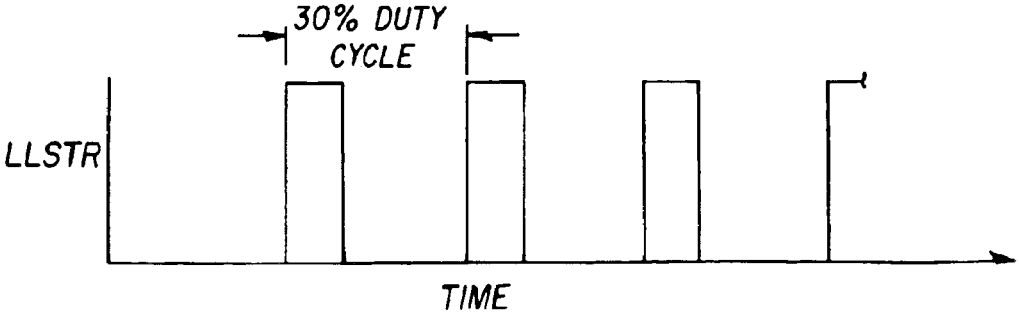
FIG. 14 is a timing diagram similar to that of FIG. 13 but illustrating a group of low-level strobe signals with a lower duty cycle than that illustrated in FIG. 13.

With reference now to FIGS. 12–14 a second embodiment of the invention will now be described. In this second embodiment for operating the heater elements in the overlap region the high-level strobe signal HLSTR remains constant at 90 percent duty cycle and is similar to that used in the non-overlap area. However, instead the low-level strobe signal LLSTR is modified on a line by line basis linearly so that in the non-overlap area the duty cycle for the low-level strobe signal LLSTR is sixty percent duty cycle, see FIG. 12, This low-level strobe signal duty cycle decreases to zero at line 1006 during recording of the image using the first triad of color patches. Illustrated in FIG. 14 is the low-level strobe signal of the duty cycle of 30 percent whereas in FIG. 13 the low-level strobe signal has a duty cycle of sixty percent which is the case in the non-overlap area. In the second embodiment during recording of the image using the second triad of color patches the low-level strobe signal LLSTR starts out at zero percent duty cycle for line 923 and linearly increases from zero percent to sixty percent duty cycle at line 1006. It will be understood that the number of low-level strobe signals in a high-level strobe signal of a predetermined remains the same for the embodiment of FIGS. 12–14 since the duration of the on time of the heater element is related to the duty cycle of the low-level strobe signal multiplied by the number of such signals.

With reference now FIG. 5 in the above to embodiments density printed using each color patch from the two triads of color patches had adjustment of contribution in the overlap region by using changes in the duty cycles of the strobe signals; i.e. either the high-level strobe signal or the low-level strobe signal. In a third embodiment adjustment of contribution is made through adjustment of the image data sent to the print head. Thus, in an example where the printhead uses a high-level strobe signal having a 90 percent duty cycle and a low-level strobe signal having a 60 percent duty cycle, such duty cycles are not changed in this third embodiment even during printing in the overlap region. Instead, different lookup tables are used for controlling gradation or gray level image data sent to the print head. As noted from FIG. 3, there are eight data lines, DATA 0–7 which can define many gray or density levels up to 255 levels. Where multiple transmissions of data over such lines are made for recording a single pixel, the number of density levels can be increased accordingly.

In this third embodiment, the internal gradation converter 103 is provided with a predetermined setting when printing using the first set of color patches and printing lines 1 through 922. Such setting can be accomplished by adjustment of conversion coefficients from table 102 or from the input of various correction data input into the converter 103. Similarly, for lines 1007 through 2100, and during which recording is made using solely the second triad of color patches, the settings for such internal gradation converter 103 will be the same as for recording using the first triad of color patches, wherein the only difference is that the image data PDATA is likely to vary in accordance with the image. However, when recording is made in the overlap region, lines 923 through 1006, a different lookup table of values is provided to modify the image data in accordance with line number of the line being recorded. Thus, in recording using the first triad set of color patches the density of the image data will be changed with line numbers so that for gray level pixels recorded using the first triad of color patches, and such pixels being located closer to line 923, the amount of contribution by the first set of color patches to record that pixel will be greater and the contribution by the second set of color patches will be less. Similarly, when recording gray level pixels using the second triad of color patches in the overlap region the density of the images is adjusted for use of values from a lookup table so that the contribution to density of the resulting printed pixel is greater for the second triad of color patches for pixels that are closer to line 1006. There is a similar decrement by line number or increment by line number as described for the other embodiments except that the result appears in the image data sent to the printhead rather than through adjustment of the enabling signals of the printhead.

All three embodiments of the invention described herein are similar in that a pixel being recorded is recorded at the correct gray level or density whether in the overlap region or not and any pixel in the overlap region is recorded through a contribution of both triads of color patches.

In each of the above three embodiments and for those systems using the quad set of color patches, the transparent overcoat may be applied or recorded over the image using a different approach. For example, it may be preferable to apply the transparent overcoat forming a part of the first quad of color patches using the printhead and having all the recording elements thereof be at a constant heating level so that the transparent patch of the first quad is applied during recording lines 1 through 922 when the transparent patch is between the printhead and the receiver sheet. Only the first 922 lines are employed in recording using this first transparent patch since the remainder of the pixels in the overlap region need to be completed in their recording or printing using the second quad of color patches. After recording the complete image using the three color dye patches of the second quad the second transparent patch and forming a part of the second quad set of color patches is then used to be applied over lines 923 through 2101. In transferring the transparency material to the receiver sheet over the sub image formed by each triad it may also be desirable to modulate nonuniformly the enablement and heating of the recording elements of the printhead during the transfer of the transparency material to modify the finish on the obtained print so that a matte or modified gloss finish is provided to the completed print.

Figure 17:
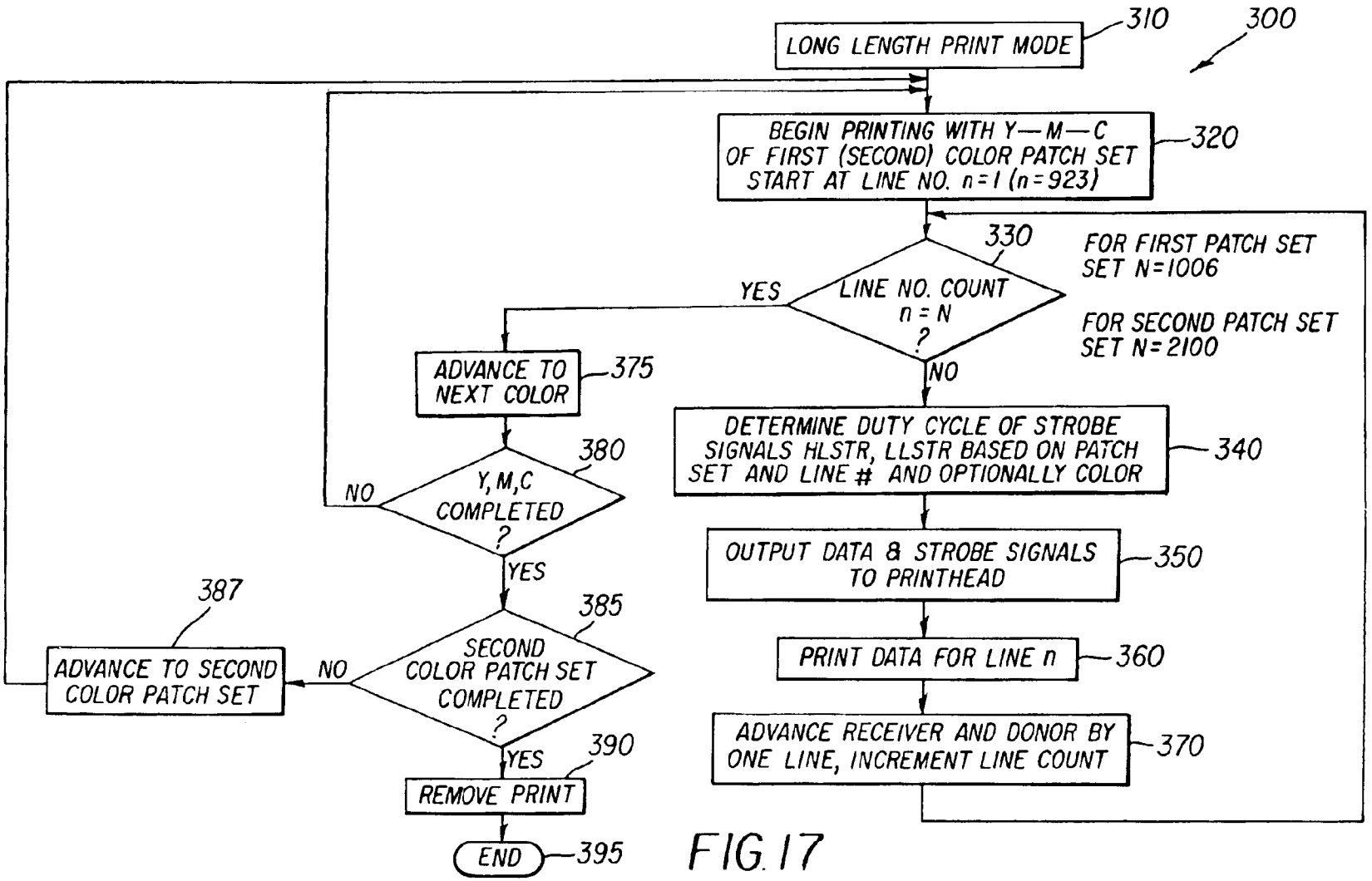
FIG. 17 is a flowchart for printing a longer length image in accordance with the invention.

With reference now to the flowchart 300 of FIG. 17 where a long length print mode is selected, step 310, printing is begun, step 320, with the first color of the first color patch set and started at line number n=1. After selecting the first line or a subsequent line for printing a determination is made, step 330, of the line number count and whether or not it is the last line of the sub image, N=1006 for the first patch set or triad or quad of color patches or N=2100 for the second patch set or triad of quad of color patches. If the answer is no a determination is made, step 340, of the duty cycle of strobe signals HLSTR, LLSTR based on patch set and line number and optionally color. Note that the duty cycles of both HLSTR and LLSTR may vary with color of the patch. In step 350 data and strobe signals are output to the printhead and in step 360 the data for a line n is printed. After printing of this line the receiver and donor web are advanced by one line increment and the line counter is incremented as well. Thus steps 330,340,350,360 and 370 of repeated until the line number count n=N for that color patch. Upon completion of the printing using the present color patch the next color patch is advanced to the printhead, step 375. A determination is made in step 380 as to whether or not the three or four color (three colors and one transparency) patches are completed, step 380. If not printing is begun with the next color patch, step 320. Steps 330,340,350,360,370 are repeated until the terminal count N is reached for that color patch. In step 380 a determination is made as to whether or not the yellow, magenta, cyan and optionally the transparent patch are completed for that triad or quad of color patches. If yes then a determination is made in step 385 as to whether or not printing with the second color patch set has been completed. If not, advancement is made of the second color patch set for printing, step 387. The beginning of printing for the second color patch set will be started at line n=923 of the receiver sheet and printing will be complete for each color patch of the second triad or quad of color patches when the line number count is N=2100. When printing is complete using the second color patch set the print is removed from the printer, step 390 and printing stops for that print.

The printing of the two sub-images to form a composite image has the pixels in the overlap region formed by combining deposition of material from the color patches of each triad or quad of color patches. That is a gray level pixel in the overlap region is formed by material from both triads or both quads. In the overlap region the high-level strobe signal HLSTR and/or the low-level strobe signal LLSTR are modified on a changing line by line basis as described herein to adjust the contributions of the transference of colorants from each of the triads or quads to each gray level pixel. As used herein a gray level pixel is defined to have a density that can be made variable in accordance with image data to more than two levels of density including no density.

The receiver sheet employed herein may be a discrete sheet of predetermined size or a continuous receiver sheet in which the composite image formed by the two sub-images are formed. The receiver sheet may have microperfs to define an image area so that the composite image is formed within the boundary defined by the microperfs and optionally the side edges of the receiver sheet. The microperfs may then be used to facilitate removal of the unprinted border of the receiver sheet from the printed portion having the composite image.

Figure 18:
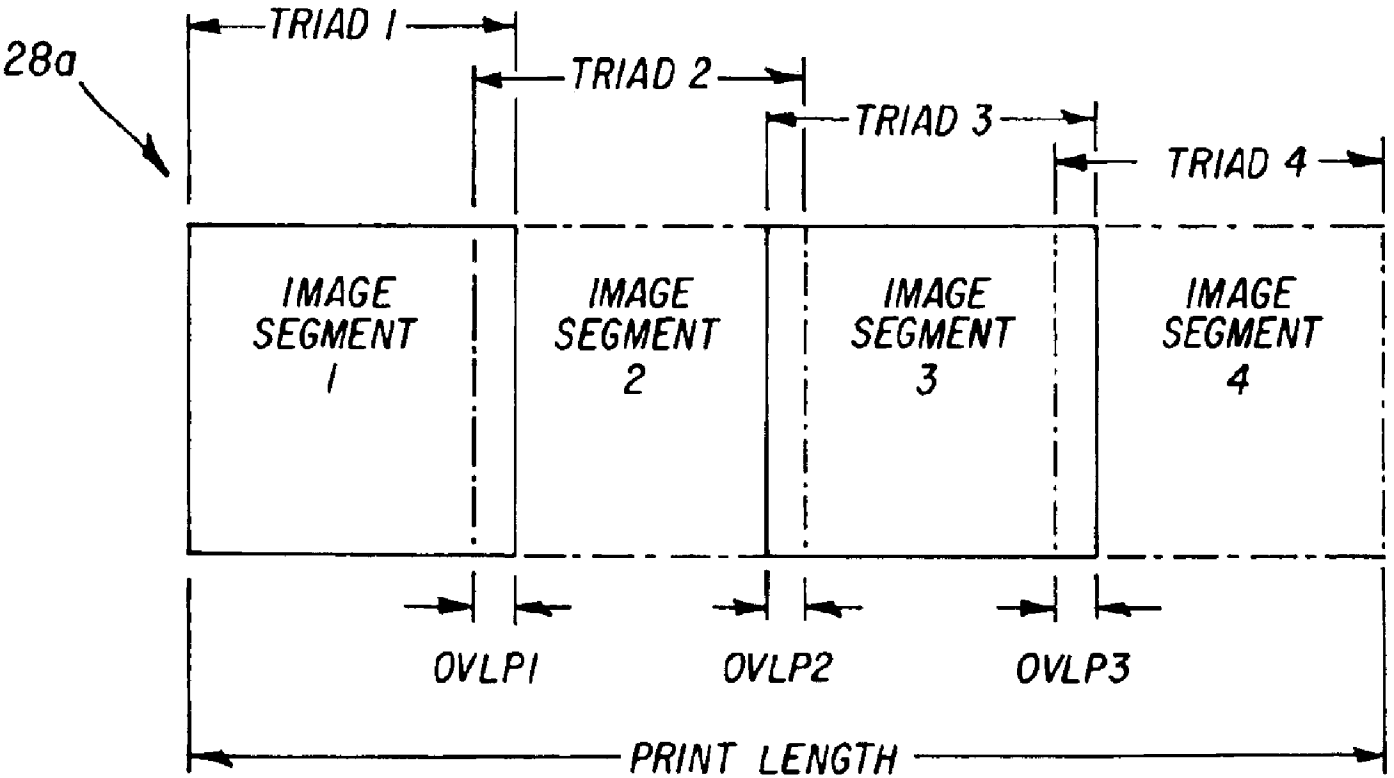
FIG. 18 is an illustration showing printing of an elongated image using more than two triads or quads and more than one overlap area.

In the above embodiments, description has been provided relative to forming a long length image using two triads or quads of color dye transfer patches. The invention may also use three or more triads or quads to create even longer length images. As may be noted with regard to FIG. 18, receiver 28*a* is shown that includes an image formed thereon wherein the image is created using four triads as identified in the figure. The first part of the image, image segment 1, can be formed starting at the left-hand edge of the receiver 28*a* using triad1 (or quad1) and is formed according to normal practice of thermal image printing as described above until the first overlap area, OVLP1, is to be formed. For this first overlap area, the creation of same is identical to that described with regard to the flow chart of FIG. 17 and the specification description pertaining thereto. The second part of the image, image segment 2, is then formed using triad2 (or quad2) also in accordance with the flow chart of FIG. 17 and the specification description relative thereto. It will be understood that in all cases where two or more triads or quads are to be used to print a long length image that in addition to movement of the different triads or quads into position beneath the printhead, the receiver sheet typically will also need to be moved backwards, to the right in FIG. 18, in order to position the printhead for printing with the next triad or quad at the beginning of a respective overlap area. After complementary printing of the overlap area OVLP1 using the triad2, printing of the second segment of the image continues normally using triad2 until commencement of a line number associated with the second overlap area, OVLP2. Beginning with this line number, the duty cycle of the strobe signals are adjusted on a line by line basis as described for step 340 in FIG. 17 as was the case for printing using the triad1 when printing OVLP1. After completion of printing of the second image segment including the OVLP2 using the second triad of patches of the image, the complementary printing to complete OVLP2 is printed using the third set of triads, triad3 (or quads3). This complementary printing of OVLP2 is similar to that described for complementary printing of OVLP1 using triad2. The printing of the remainder of image segment 3 by triad3 continues normally. When the line number for the image line corresponding to the beginning of the third overlap area, OVLP3, is met, the printing of this portion of image segment 3 and of image segment 4 is similar to that described above with regard to printing of OVLP1 and image segment 2. That is, the gray levels of printed pixels tend to linearly decrease in the direction of increasing line numbers until image segment 3 is completed using triad3 (or quad3). Thereafter, the receiver sheet 28*a* is shifted backwards to the right and the first of the color patches for triad4 is shifted to beneath the printhead for complementary printing of the pixels of image segment 4 including OVLP3. In the complementary printing of OVLP3, the density of the complementary portion of each pixel tends to increase with increasing line number through adjustment to the strobe pulses as described in the specification for printing of an overlap area.

Where printing with quads is employed, the printing of the transparent overcoat uses a transparent patch area with each triad of colors. For each overlap area, depositing or printing of the transparent overcoat will not be made using the transparent patch of the first quad series used to print the respective overlap area. This is done to allow the second or completing quad series used to print the respective overlap area to deposit dye when completing complementary printing of the respective overlap area. So, therefore, it would be the transparent patch of the completing quad that is used to provide the transparency material for covering the respective overlap area. For example, the transparent patch of quad3 would be used to print or deposit transparent material upon overlap area OVLP2 whereas the transparent patch for quad2 would not be used at all upon OVLP2 but would instead be used for printing or depositing transparent material upon OVLP1 and the non-overlapped area of image segment 2.

Figure 19:
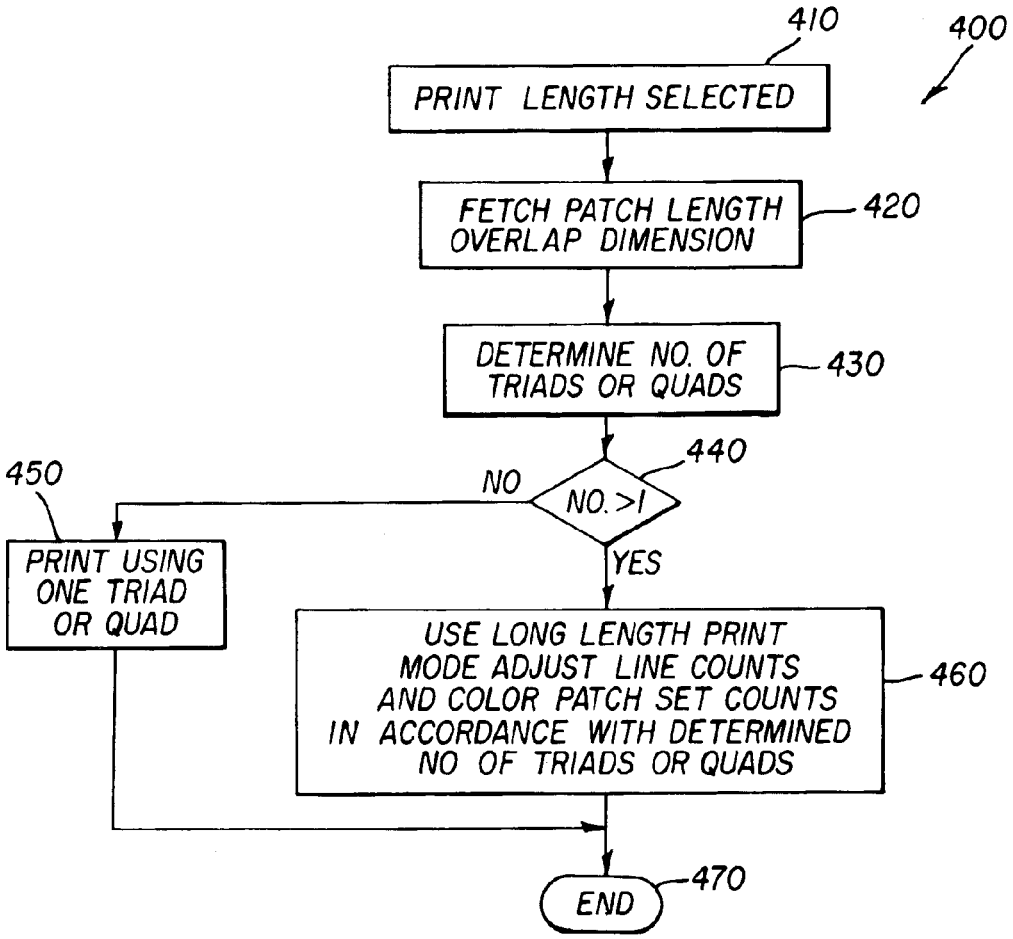
FIG. 19 is a flowchart for operating a printer in printing of an elongated image in accordance with the embodiment illustrated in FIG. 18.

With reference to the flow chart 400 of FIG. 19, the operator may select a print length in step 410. This may be an option provided by a display and button inputs associated therewith or through a computer terminal or personal computer suitably connected to the printer and programmed to allow input of print length. For example, options may be provided for print length dimensions of 1×5, 2×5, 3×5, 3.5×5, 4×5, 6×5, 7×5, . . . etc (dimensions in inches and assuming a printhead having a length of 5 inches and the first number of the dimension represents print length). Thus, assuming that each color patch in a triad or quad of color patches is of a 4×5 dimension, step 420, a single triad or quad may be used to print print lengths of 1, 2, 3, 3.5 and 4 inches. For print lengths of 5, 6 and 7 inches two triads or quads of color patches are required. For print lengths of 8, 9, 10 and 11 inches, three triads or quads of color patches are required. For print lengths of 12, 13, 14 and 15 inches, four triads or quads of color patches are required. These values may be stored in a memory associated with a computer so that upon selection of a print length the number of triads or quads to be used is determined, step 430, or can be calculated from a simple algorithm involving color patch length and overlap length, recognizing that the number of triads or quads required is one more than the number of overlap regions needed. Based on the print length dimension selected, a determination is made as to whether or not more than one triad or quad is required, step 440. If only one triad or quad of color patches is required, then printing is made using the one triad or quad in accordance with normal print mode, step 450. If more than one triad or quad is required then the long length printing mode is selected and the long length print mode described above is employed with selective use of two adjacent triads or quads to print within an overlap area and preferably using the complementary gray level printing technique described above, step 460. When printing of the image is complete in either mode, the process steps to step 470 which initializes the machine for taking the next print job.

In the above description of printing, assumption is made that the image is formatted by an image processor for the print format or print length selected. The print length selected may be in accordance with the image file provided for printing or modified through well-known image processing techniques, such as extrapolation of pixels or image rotation, to form an image file for printing that is suited for the print length or print format selected for printing.

It is to be appreciated and understood that the specific embodiments of the invention are merely illustrative of the general principles of the invention. Various modifications may be made by those skilled in the art which are consistent with the principles set forth.

What is claimed is:

1. A method of thermally printing a desired image on a receiver comprising the steps of:

(a) thermally printing a first sub-image on a first region of the receiver with a first dye-donor patch of a first color having a length that is less than than a length of the receiver;

(b) thermally printing a second sub-image on a second region of the receiver with a second dye-donor patch of the first color and having a length that is less than the length of the receiver;

the first and second regions of the receiver having a partial overlap region;

the first and second sub-images form the desired image (or a single color printed record of the desired image) which is longer in length than either of the first and second dye-donor patches;

wherein in steps (a) and (b) the thermal printing is made with the same printhead having a plurality of thermally actuated recording elements, the recording elements being actuated to print the first sub-image and the second sub-image each with pixels of varying gray levels, and further wherein pixels in the overlap region are printed with varying gray levels during both of steps (a) and (b) and wherein at pixels locations in the overlap region most printed pixels are printed by overlapping a partial pixel printed during printing step (a) with another partial pixel printed during printing step (b).

2. The method according to claim 1 and wherein during printing of a pixel in each of steps (a) and (b) in a region outside of the overlap region a signal to a recording element of the printhead is strobed to a first predetermined duty cycle and during printing of the overlap region in step (a) a partial pixel is created in the overlap region by providing a signal to the same recording element printhead that is strobed to a second predetermined duty cycle lower than the first predetermined duty cycle.

3. The method according to claim 2 and wherein lines of pixels in the overlapped region are printed during step (a) by gradually reducing the duty cycle used in printing of each partial pixel as the line number is changed in moving of printing towards the end of the first sub-image.

4. The method according to claim 3 and including the steps of:

(c) thermally printing a third sub-image on the first region of the receiver with a first dye-donor patch of a second color having a length that is less than the length of the receiver;

(d) thermally printing a fourth sub-image on the second region of the receiver with a second dye-donor patch of the second color and having a length that is less than the length of the receiver;

the first and second regions of the receiver having the partial overlap region in printing steps (c) and (d);

the first, second, third and fourth sub-images forming the desired image (or a two-color printed record of the desired image) which is longer in length than either of the first and second dye-donor patches of the second color;

wherein in steps (c) and (d) the thermal printing is made with the same printhead as used in steps (a) and (b), the recording elements being actuated to print the third sub-image and the fourth sub-image each with pixels of varying gray levels, and further wherein pixels in the overlap region are printed with varying gray levels during both of steps (c) and (d) and wherein at pixels locations in the overlap region most printed pixels are printed by overlapping a partial pixel printed during printing step (c) with another partial pixel printed during printing step (d).

5. The method according to claim 4 and including the steps of:

(e) thermally printing a transparent overcoat on the first region of the receiver with a first transparent-donor patch of a length that is less than the length of the receiver;

(f) thermally printing a transparent overcoat on the second region of the receiver with a second transparent-donor having a length that is less than the length of the receiver;

the first and second regions of the receiver having the partial overlap region in printing steps (e) and (f) and wherein in steps (e) and (f) the thermal printing is made with the same printhead as used in steps (a) and (b).

6. The method according to claim 5 and wherein in thermally printing the transparent overcoat in the partial overlap region only a first set of predetermined image line numbers in the partial overlap region are printed exclusively in step (e) and a second set of different predetermined image line numbers in the partial overlap region are printed exclusively in step (f) so that no line number is in both the first and second sets.

7. The method according to claim 2 and including the steps of:

(c) thermally printing a transparent overcoat on the first region of the receiver with a first transparent-donor patch of a length that is less than the length of the receiver;

(d) thermally printing a transparent overcoat on the second region of the receiver with a second transparent-donor having a length that is less than the length of the receiver;

the first and second regions of the receiver having the partial overlap region in printing steps (c) and (d) and wherein in steps (c) and (d) the thermal printing is made with the same printhead as used in steps (a) and (b).

8. The method according to claim 1 and including the steps of:

(c) thermally printing a transparent overcoat on the first region of the receiver with a first transparent-donor patch of a length that is less than the length of the receiver;

(d) thermally printing a transparent overcoat on the second region of the receiver with a second transparent-donor having a length that is less than the length of the receiver;

the first and second regions of the receiver having the partial overlap region in printing steps (c) and (d) and wherein in steps (c) and (d) the thermal printing is made with the same printhead as used in steps (a) and (b).

9. The method according to claim 1 and wherein during printing of a pixel in each of steps (a) and (b) in a region outside of the overlap region a signal to a recording element of the printhead establishes heat energy on time for recording a pixel of a predetermined gray level and during printing of the overlap region in step (a) a signal for recording the same predetermined gray level is recorded as a partial pixel in the overlap region by providing a signal to the same recording element that establishes a lesser amount of time that energy is provided to the recording element.

10. The method according to claim 9 and wherein lines of pixels in the overlapped region are printed during step (a) by gradually reducing the duty cycle used in printing of each partial pixel as the line number is changed in moving of printing towards the end of the first sub-image.

11. The method according to claim 10 and including the steps of:

(c) thermally printing a third sub-image on the first region of the receiver with a first dye-donor patch of a second color having a length that is less than the length of the receiver;

(d) thermally printing a fourth sub-image on the second region of the receiver with a second dye-donor patch of the second color and having a length that is less than the length of the receiver;

the first and second regions of the receiver having the partial overlap region in printing steps (c) and (d);

the first, second, third and fourth sub-images forming the desired image (or a two-color printed record of the desired image) which is longer in length than either of the first and second dye-donor patches of the second color;

wherein in steps (c) and (d) the thermal printing is made with the same printhead as used in steps (a) and (b), the recording elements being actuated to print the third sub-image and the fourth sub-image each with pixels of varying gray levels, and further wherein pixels in the overlap region are printed with varying gray levels during both of steps (c) and (d) and wherein at pixels locations in the overlap region most printed pixels are printed by overlapping a partial pixel printed during printing step (c) with another partial pixel printed during printing step (d).

12. The method according to claim 11 and including the steps of:

(e) thermally printing a transparent overcoat on the first region of the receiver with a first transparent-donor patch of a length that is less than the length of the receiver;

(f) thermally printing a transparent overcoat on the second region of the receiver with a second transparent-donor having a length that is less than the length of the receiver;

the first and second regions of the receiver having the partial overlap region in printing steps (e) and (f) and wherein in steps (e) and (f) the thermal printing is made with the same printhead as used in steps (a) and (b).

13. The method according to claim 12 and wherein in thermally printing the transparent overcoat in the partial overlap region only a first set of predetermined image line numbers in the partial overlap region are printed exclusively in step (e) and a second set of different predetermined image line numbers in the partial overlap region are printed exclusively in step (f) so that no line number is in both the first and second sets.

14. The method according to claim 1 and wherein in printing step (a) color image data of pixels to be printed in the partial overlap region are input to a lookup table which provides as an output modified gray levels of the partial pixels to be printed, the modified gray levels being progressively reduced in accordance with printing line number.

15. The method according to claim 14 and including the steps of:

(c) thermally printing a transparent overcoat on the first region of the receiver with a first transparent-donor patch of a length that is less than the length of the receiver;

(d) thermally printing a transparent overcoat on the second region of the receiver with a second transparent-donor having a length that is less than the length of the receiver;

the first and second regions of the receiver having the partial overlap region in printing steps (c) and (d) and wherein in steps (c) and (d) the thermal printing is made with the same printhead as used in steps (a) and (b).

16. The method according to claim 15 and wherein in thermally printing the transparent overcoat in the partial overlap region only a first set of predetermined image line numbers in the partial overlap region are printed exclusively in step (c) and a second set of different predetermined image line numbers in the partial overlap region are printed exclusively in step (d) so that no line number is in both the first and second sets.

17. A method of thermally printing a desired image on a receiver with a printhead comprising the steps of:

(a) thermally printing with the printhead a first sub-image on a first region of the receiver with a first dye-donor patch of a first color having a length that is less than than a length of the receiver;

(b) subsequent to step (a) thermally printing with the printhead a second sub-image on a second region of the receiver with a second dye-donor patch of the first color and having a length that is less than the length of the receiver;

the first and second regions of the receiver having a partial overlap region;

the first and second sub-images form the desired image (or a single color printed record of the desired image) which is longer in length than either of the first and second dye-donor patches;

(c) thermally transferring a transparent overcoat on the first sub-image in the first region exclusive of the overlap region of the receiver with a first transparent donor patch of a length that is less than the length of the receiver;

(d) thermally transferring a transparent overcoat on the second sub-image in the second region inclusive of the overlap region of the receiver with a second transparent donor patch having a length that is less than the length of the receiver;

and wherein in steps (c) and (d) the thermal transferring is made with the same printhead as used in steps (a) and (b) and wherein step (d) is performed after step (c).

18. A method of thermal printing to form an elongated image wherein material is transferred from a donor sheet having a repeating series of color patches, each series having plural different colors, the method comprising:

operating a printhead with each of at least two of the series of color patches to transfer material, using heat from the printhead, from each of the series of color patches to a receiver sheet to form on the receiver sheet a respective color sub-image from each of the series of color patches, the respective sub-images forming a composite image that has gray level pixels in an overlap region formed by combining deposition of material from the color patches of each series of color patches so that a gray level pixel in the overlap region is formed by material from both the series of color patches.

19. The method of claim 18 and wherein a strobe signal is modified on a line-by-line basis when printing with the printhead in the overlap region.

20. The method of claim 18 and thermally transferring a transparent overcoat on a first sub-image in a first region exclusive of the overlap region of the receiver sheet with a first transparent donor patch of a length that is less than the length of the receiver sheet; and thermally transferring a transparent overcoat on a second sub-image in a second region inclusive of the overlap region of the receiver sheet with a second transparent donor patch having a length that is less than the length of the receiver sheet;

and wherein the thermal transferring of the transparent overcoats are made with the same printhead as used for printing the respective color sub-images forming the composite image.

21. A method of thermal printing to form an elongated image on a receiver sheet wherein material is transferred from a donor sheet or ribbon having a repeating series of color patches to the receiver sheet, each series having plural patch areas of respective different colors, the method comprising:

defining a print length of an image to be printed;

determining from said print length a number of series of color patches required to print the elongated image; and printing the image on the receiver using a printhead and the determined number of series of color patches, wherein adjacent series of color patches on the donor sheet or ribbon are used by the printhead to print an overlap area between two image area segments printed respectively using one of each of the adjacent series of color patches.

22. The method according to claim 21 and wherein the elongated image is printed on the receiver sheet with at least two overlap areas and at least three series of color patches.

23. The method according to claim 22 and wherein the printhead is operated to transfer material, using heat from the printhead, from each of the series of color patches to the receiver sheet to form on the receiver sheet respective colors, wherein a composite image that has gray level pixels in each overlap area is formed by combining deposition of material from the color patches of each of two adjacent series of color patches so that a gray level pixel in each overlap area is formed by material from both of two adjacent series of color patches.

24. The method according to claim 23 and wherein material from a color patch of a particular color from one series of color patches is combined with material from a color patch of the particular color from a second series of color patches to form a gray level pixel of the particular color in the overlap area.

25. The method according to claim 21 and wherein a transparent overcoat is applied to the image that is printed and the transparent overcoat is applied to the overlap area only after the two image area segments are printed in color using the adjacent series of color patches.

26. An apparatus for thermal printing an elongated image wherein material is transferred from a donor sheet or ribbon having a repeating series of color patches, each series having plural different colors, the apparatus comprising: a thermal printhead in contact with the donor sheet or ribbon; and a controller programmed to control operation of the printhead with each of at least two of the series of color patches to transfer material, using heat from the printhead, from each of the series of color patches to a receiver sheet to form on the receiver sheet a respective color sub-image from each of the series of color patches, the respective sub-images forming a composite image that has gray level pixels in an overlap region formed by combining deposition of material from the color patches of each series of color patches so that a gray level pixel in the overlap region is formed by material from both the series of color patches.

* * * * *